US008349766B2

(12) United States Patent
Ohga

(10) Patent No.: US 8,349,766 B2
(45) Date of Patent: Jan. 8, 2013

(54) THERMOSENSITIVE RECORDING MATERIAL

(75) Inventor: Kunihiko Ohga, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 321 days.

(21) Appl. No.: 12/905,118

(22) Filed: Oct. 15, 2010

(65) Prior Publication Data

US 2011/0092365 A1 Apr. 21, 2011

(30) Foreign Application Priority Data

Oct. 21, 2009 (JP) ..... 2009-242587

(51) Int. Cl.
*B41M 5/30* (2006.01)

(52) U.S. Cl. ..... 503/226; 503/207

(58) Field of Classification Search ..... None
See application file for complete search history.

(56) References Cited

FOREIGN PATENT DOCUMENTS

| | | | |
|---|---|---|---|
| JP | 04-101883 | A | 4/1992 |
| JP | 04-244264 | A | 9/1992 |
| JP | 07-031918 | A | 2/1995 |

*Primary Examiner* — Bruce H Hess
(74) *Attorney, Agent, or Firm* — SOLARIS Intellectual Property Group, PLLC

(57) ABSTRACT

A thermosensitive recording material including, on a support having a type D durometer hardness of 40 or more as defined in accordance with ISO 7619:2004, and sequentially from the support side, an undercoating layer having a dynamic microhardness at 25° C. of 5.0 mN or less; and a thermosensitive color-forming layer containing an electron-donating dye precursor and an electron-accepting compound for thermal color-formation of the electron-donating dye precursor.

9 Claims, 2 Drawing Sheets

THERMOSENSITIVE RECORDING MATERIAL

CROSS-REFERENCE TO RELATED APPLICATION

This application claims priority under 35 USC 119 from Japanese Patent Application No. 2009-242587 filed on Oct. 21, 2009, the disclosure of which is incorporated by reference herein.

BACKGROUND OF THE INVENTION

1. Field of the Invention

The present invention relates to a thermosensitive recording material.

2. Description of the Related Art

A thermosensitive recording method is advantageous in that (1) development is unnecessary, (2) in a case in which the support is a paper, its paper quality is similar to that of plain paper, (3) handling is easy, (4) color density is high, (5) a recording apparatus is simple and inexpensive, and (6) there is no noise during recording. Accordingly, thermosensitive recording materials are widely used as recording media in facsimiles, automated ticketing machines and scientific measurement devices as well as output media in various printers or plotters for POS labels, CAD, medical images and the like. Among them, a multilayered synthetic paper, a biaxially-stretched thermoplastic resin film optionally containing an inorganic pigment or a transparent support is used in an image printer for medical images, which requires uniformity and high resolution of the recorded images, and in a CAD plotter, which requires dimensionally stable fine-line recording. In particular, slight white deletion, mottling, streaks or the like of the image in image printer paper for medical images may lead to misjudgment in the field of medical treatment, so there is a need for a contrivance which prevents occurrence of image defects.

As a countermeasure against the occurrence of image defects, there is considered an approach which prevents foreign matter, such as dust, from adhering to a support or on a coated surface during production. For example, there has been proposed a method of reducing image defects by designing a coating method or a coating device, even when coarse particles are contained in the coating liquid (for example, see Japanese Patent Application Laid-Open (JP-A) Nos. 04-101883, 04-244264, and 07-031918). However, such methods use a specific support or require a special apparatus, and the reduction of image defects cannot be said to be satisfactory.

SUMMARY OF THE INVENTION

According to an aspect of the invention, there is provided a thermosensitive recording material comprising, on a support having a type D durometer hardness of 40 or more as defined in accordance with ISO 7619:2004, and sequentially from the support side, an undercoating layer having a dynamic microhardness at 25° C. of 5.0 mN or less; and a thermosensitive color-forming layer containing an electron-donating dye precursor and an electron-accepting compound for thermal color-formation of the electron-donating dye precursor.

DETAILED DESCRIPTION OF THE INVENTION

The thermosensitive recording material of the present invention includes a support having a type D durometer hardness of 40 or more as defined in accordance with ISO 7619:2004 (JIS K6253 (1997)), the disclosure of which is incorporated by reference herein, and sequentially from the support side, an undercoating layer having a dynamic microhardness at 25° C. of 5.0 mN or less, and a thermosensitive color-forming layer containing an electron-donating dye precursor and an electron-accepting compound for thermal color-formation of the electron-donating dye precursor.

Figure 1A:
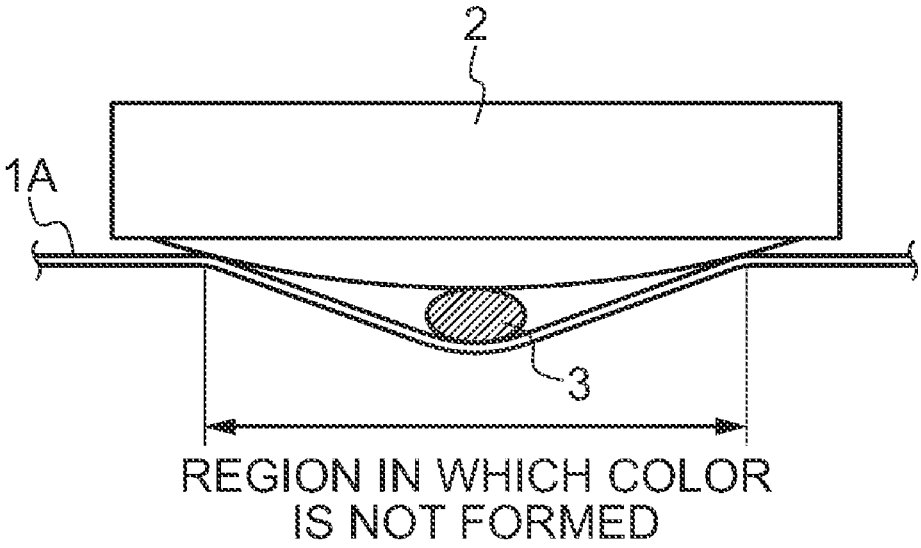
FIGS. 1A and 1B are schematic views for illustrating a difference in mechanism, by which an effect is obtained, between the thermosensitive recording material in accordance with the present invention and the conventional thermosensitive recording material.

Conventionally, when foreign matter, such as dust, adheres to the surface of a thermosensitive recording material in the case where the thermosensitive recording material itself has a high hardness due to high hardness of a support, foreign matter 3 is trapped between the thermosensitive recording material 1A and a thermal head 2, thus leading to an increase in a region where no contact is made between the thermosensitive recording material 1A and the thermal head 2, when performing thermosensitive recording on the thermosensitive recording material 1A, as shown in FIG. 1A. Then, the non-contacted region does not undergo color formation, thereby causing significant image defects due to the lack of color formation.

Figure 1B:
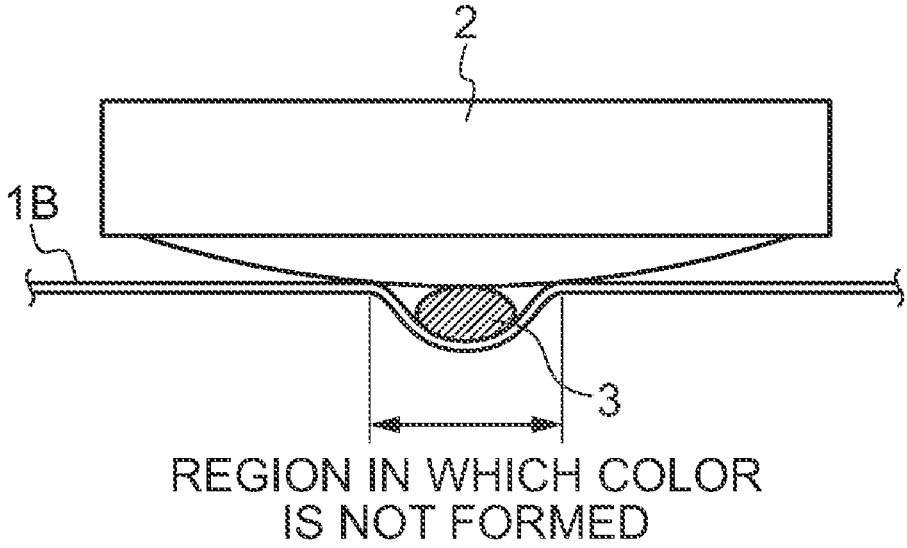

On the other hand, since the thermosensitive recording material of the present invention has an undercoating layer having a dynamic microhardness at 25° C. of 5.0 mN or less, when performing thermosensitive recording, even if the type D durometer hardness in accordance with ISO 7619:2004 of the support to be used is 40 or more, the thermosensitive recording material 1B undergoes deformation in conformance with the shape of the foreign matter 3 even when the foreign matter 3 is trapped between the thermosensitive recording material and the thermal head 2, as shown in FIG. 1B, whereby the region can be reduced where no contact is made between the thermosensitive recording material 1B and the thermal head 2. Thereby, image defects due to a lack of color formation can be reduced.

Figure 2:
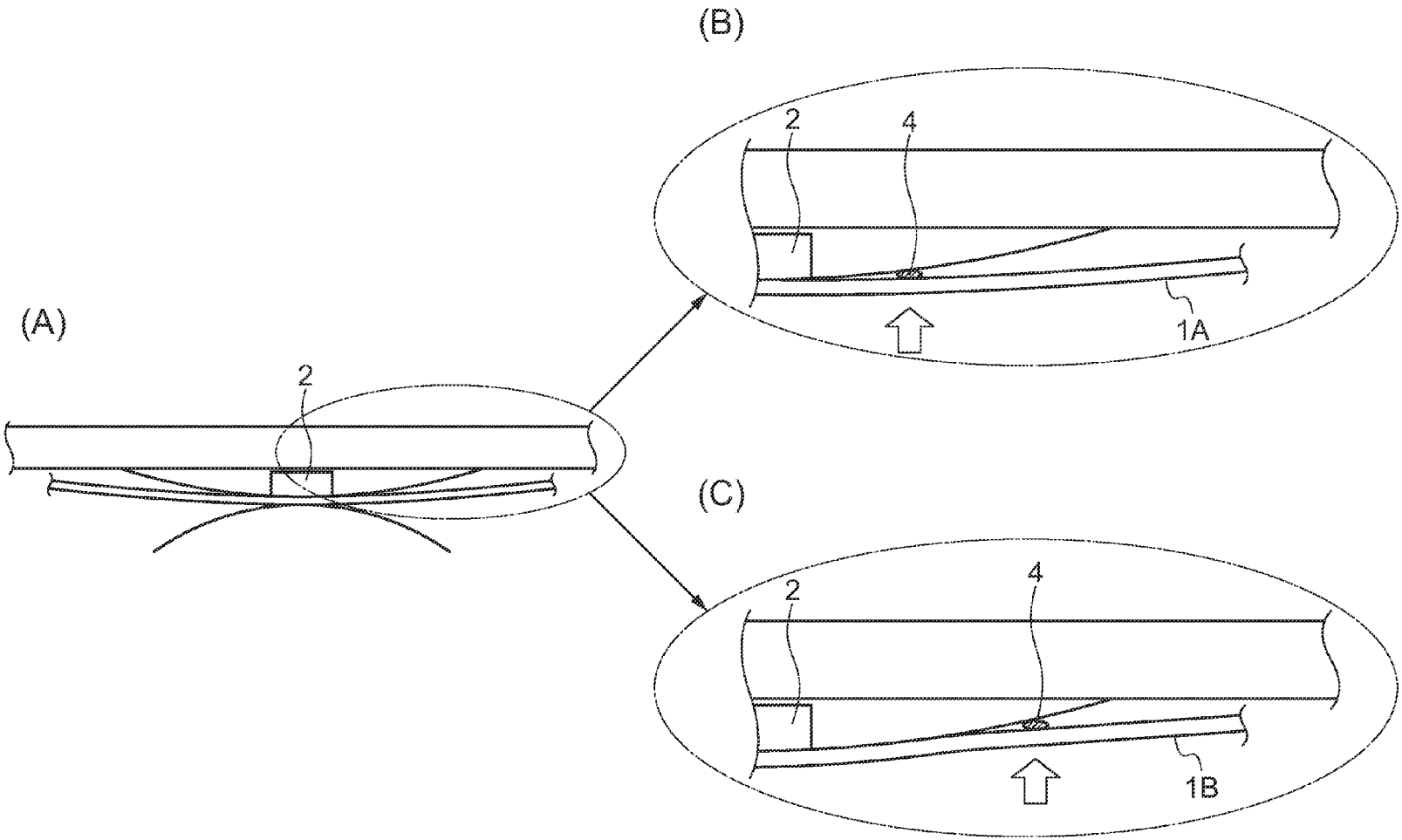
FIG. 2 is a schematic view for illustrating a difference in mechanism, by which an effect is obtained, between the thermosensitive recording material in accordance with the present invention and the conventional thermosensitive recording material.

Further, conventionally, in the case where the thermosensitive recording material itself has a high hardness due to the high hardness of a support, because, as shown in FIG. 2(B), deformation of the thermosensitive recording material 1A is small and a contact region is narrow, head contaminant 4 adheres to a portion close to the central region of the thermal head 2, and a high temperature is applied to the head contaminant 4 by the thermal head 2. As a consequence, a lubricant in the head contaminant 4 melts and then tends to easily adhere to the thermal head 2, which results in the occurrence of surface condition defects due to the contaminant 4, or streaks due to trapping of foreign matter in the contaminant 4 portion.

On the other hand, since the thermosensitive recording material of the present invention has an undercoating layer having a dynamic microhardness at 25° C. of 5.0 mN or less, thus giving flexibility to the surface in contact with the head, even if the type D durometer hardness in accordance with ISO 7619:2004 of the support to be used is 40 or more, deformation of the thermosensitive recording material 1B is large, and the contact region is large, and thus the head contaminant 4 adheres to a portion distant from the central region of the thermal head 2 as shown in FIG. 2(C), and a high temperature from the thermal head 2 is not readily applied to the head contaminant 4. As a result, a lubricant in the head contaminant 4 does not melt and therefore does not readily adhere to the thermal head 2, whereby the occurrence of surface condition defects due to the contaminant 4 or streaks due to trapping of foreign matter in the contaminant 4 portion is inhibited.

Further, the above-stated problems of the conventional art tend to more remarkably occur, for example, in a thermosensitive recording material having a high hardness used for medical applications or the like, that is, a thermosensitive recording material having a support whose type D durometer hardness in accordance with ISO 7619:2004 is 40 or more.

Further, the thermosensitive recording material having a high hardness used for medical applications or the like may be, for example, a thermosensitive recording material having a smoothness of 2000 sec or more as defined in accordance with ISO 5627:1995 on the surface of the support at the side having an undercoating layer. Specific examples include a thermosensitive recording material wherein the support is one type selected from a transparent support, a synthetic paper and a resin-coated paper.

From the viewpoint of softness (cushioning characteristics), the dynamic microhardness at 25° C. of the undercoating layer is preferably 3.0 mN or less.

—Measurement of Dynamic Microhardness—

The dynamic microhardness is defined as follows. When the indented depth when a load P (g weight) is applied to a triangular pyramid indenter with an apical angle of 115 degrees is taken as D (μm), the dynamic microhardness DH is represented by $DH=37.838P/D^2$. In addition, the dynamic microhardness at 25° C. is measured by using a dynamic ultra-microhardness tester (DUH-200) manufactured by Shimadzu Corporation.

—Control of Dynamic Microhardness—

In order to adjust the dynamic microhardness at 25° C. of the undercoating layer to be 5.0 mN or less, for example, the following compounds may be added to the undercoating layer.

(1) Polymer particles and a binder (2) Hollow particles with a particle diameter of 0.5 μm or greater (3) Pigment and polymer particles Details thereof will be described hereinafter.

The application amount of the undercoating layer is preferably in the range of 1 to 10 $g/m^2$. From the viewpoint of achieving sufficient cushioning characteristics, the application amount of the undercoating layer is preferably 1 $g/m^2$ or more. From the viewpoint of coated layer thickness, drying load, costs, and the like, the application amount of the undercoating layer is preferably 10 $g/m^2$ or less. Further, the application amount of the undercoating layer is more preferably in the range of 2.0 to 8.0 $g/m^2$, and particularly preferably 3.0 to 6.0 $g/m^2$.

—Rp Value when Heat is Applied—

In the present invention, an Rp value of the support, as measured by a microtopograph when heated at 100° C. for 5 sec, is preferably 10 or less (void-containing support having flatness with the Rp value of 10 or less).

In the support having the undercoating layer, an Rp value of the undercoating layer, as measured by a microtopograph when heated at 100° C. for 5 sec, is preferably 10 or less (having flatness with the Rp value of 10 or less).

With regard to a thermosensitive recording material having voids in a support or undercoating layer, the voids become swollen when heated by a thermal head during thermosensitive recording. In a case where the voids are non-uniformly present in the support or undercoating layer or the voids are non-uniformly swollen, void-induced irregularities occur on the surface of the thermosensitive recording material. The presence of irregularities leads to non-uniform contact with the thermal head, which consequently results in regions in which no color is formed.

On the other hand, when the void-containing support or void-containing undercoating layer has flatness with the Rp value of 10 or less, as measured by a microtopograph when heated at 100° C. for 5 sec, the occurrence of irregularities due to non-uniform presence of voids or non-uniform swelling of voids is inhibited even when heated by the thermal head, thereby inhibiting image defects due to no color formation.

The Rp value of the support or the undercoating layer in the undercoating layer-containing support is more preferably 8.0 or less, particularly preferably 5.0 or less.

—Measurement of Rp Value—

When measuring the Rp value, a hot plate is used as a heater. The temperature of the heater is set to 100° C. and the measuring object (i.e., a support or an undercoating layer-containing support) is heated for 5 sec. The Rp value (average value of n=5) of the heated measuring object can be obtained by a measurement using a surface tester "MICROTOPOGRAPH" (Togo Seiki Seisaku-sho, Ltd.) with a 5.5 cmϕ pressure contactor at a pressure of 5 $kg/cm^2$ for a contact time of 990 ms.

When the measuring object is an "undercoating layer-containing support", the Rp value is measured by pressing the pressure contactor against the surface of the undercoating layer opposite to the surface thereof in contact with the support. When the measuring object is a "support" before the formation of an undercoating layer, the Rp value is measured by pressing the pressure contactor against the surface of the support at the side where the undercoating layer is to be provided.

—Control of Rp Value—

The Rp value may be adjusted to be 10 or less, for example, by using a support having a smoothness of 2000 sec or more as defined in accordance with ISO 5627:1995 and a void content of 10 to 45%, providing a layer having a thermal conductivity of 0.1 W/m·K or less, or the like.

Hereinafter, the composition of individual layers constituting the thermosensitive recording material in accordance with the present invention will be described.

The thermosensitive recording material of the present invention has an undercoating layer and a thermosensitive color-forming layer on a support.

[Undercoating Layer]

The undercoating layer has a dynamic microhardness at 25° C. of 5.0 mN or less.

For example, in order to adjust the dynamic microhardness of the undercoating layer to be within the above-specified range, the following compounds may be added to the undercoating layer.

(1) Polymer particles and a binder (2) Hollow particles with a particle diameter of 0.5 μm or greater (3) Pigment and polymer particles The content ratio (mass ratio) of the polymer particles and the binder in the above (1) is preferably in the range of from 60:40 to 95:5, more preferably from 70:30 to 93:7, and particularly preferably from 80:20 to 90:10, from the viewpoint of controlling the dynamic microhardness to the above-specified range.

The content ratio (mass ratio) of the pigment and the polymer particles in the above (3) is preferably in the range of from 60:40 to 95:5, more preferably from 70:30 to 93:7, and particularly preferably from 80:20 to 90:10, from the viewpoint of controlling the dynamic microhardness to the above-specified range.

(Pigment)

As the pigment for the undercoating layer, any conventional inorganic or organic pigment can be used. The pigment is particularly preferably an oil-absorbing pigment having an oil absorbency of 40 mL/100 g (cc/100 g) or more as defined in ISO 787-5:1980 (JIS-K5101), the disclosure of which is incorporated by reference herein. Specific examples of the oil-absorbing pigment include calcined kaolin, aluminum oxide, magnesium carbonate, calcined diatomaceous earth, aluminum silicate, magnesium aluminosilicate, calcium carbonate, barium sulfate, aluminum hydroxide, kaolin, calcined kaolin, amorphous silica, urea formalin resin powder, and the like. Among them, calcined kaolin having an oil absorbency of from 70 mL/100 g to 80 mL/100 g is particularly preferable.

From the viewpoint of controlling the dynamic microhardness to be in the above-specified range, calcium carbonate, barium sulfate, and aluminum hydroxide are preferable.

(Polymer Particles)

As polymer particles for the undercoating layer, there may be exemplified SBR latex, BR latex, NBR latex, CR latex, IR latex, NR latex, urethane, styrene, PMMA, and the like.

From the viewpoint of controlling a dynamic microhardness to the above-specified range, SBR latex, BR latex, and NBR latex are preferable.

(Hollow Particles)

Hollow particles for the undercoating layer preferably have a particle diameter of 0.5 μm or greater, more preferably from 0.5 μm to 2.0 μm, and particularly preferably from 0.7 μm to 1.2 μm.

The particle diameter is measured by a laser diffraction particle size distribution measuring instrument (LA500, manufactured by Horiba, Ltd.).

As the hollow particles for the undercoating layer, for example hollow particles obtained by heat-foaming encapsulated polymer particles composed of a thermoplastic polymer are suitably used. The thermoplastic polymer may be a vinyl polymer. In particular, a crosslinked product of the vinyl polymer is suitably used. Examples of the crosslinked product of the vinyl polymer include a crosslinked product of a copolymer composed mainly of any of acrylic acid ester, ethylene, propylene, vinyl acetate, styrene, acrylonitrile, and methacrylonitrile.

From the viewpoint of controlling a dynamic microhardness to the above-specified range, a crosslinked product of a copolymer composed mainly of any of ethylene, propylene, and vinyl acetate is preferable.

Production of the hollow particles is carried out, for example, by using a method described in paragraphs [0018]-[0020] of JP-A No. 2008-62404 or the like.

(Binder)

The binder for the undercoating layer may be a water-soluble polymer, or an aqueous binder. These may be used individually or in a combination of two or more types. Examples of the water-soluble polymer include, for example, starch, polyvinyl alcohol, polyacrylamide, carboxymethyl cellulose, methyl cellulose, casein, and the like. The aqueous binder is generally synthetic rubber latex or synthetic resin emulsion, and examples of the aqueous binder include styrene-butadiene rubber latex, acrylonitrile-butadiene rubber latex, methyl acrylate-butadiene rubber latex, vinyl acetate emulsion, and the like.

From the viewpoint of controlling a dynamic microhardness to the above-specified range, polyvinyl alcohol and styrene-butadiene rubber latex are preferable.

The amount of the binder used for the undercoating layer is determined in consideration of the balance between film strength, thermosensitivity of the thermosensitive color-forming layer, and the like. The amount of the binder used for the undercoating layer is preferably from 3 to 100 mass %, more preferably from 5 to 50 mass %, still more preferably from 8 to 15 mass %, based on the mass of the pigment for the undercoating layer. The undercoating layer may also include wax, a discoloration inhibitor, a surfactant, and the like.

Coating of the coating liquid for forming the undercoating layer can be carried out by coating methods known in the art. Specific examples include coating methods of using an air knife coater, a roll coater, a blade coater, a gravure coater, a curtain coater, and the like. Among them, coating methods of using a curtain coater or a blade coater are preferable, and a coating method of using a blade coater is more preferable. After coating and drying, the undercoating layer may be further subjected to smoothing treatment such as calendar treatment, if necessary.

Examples of the method of using a blade coater include not only coating methods of using a blade of bevel- or bent-type but also a rod blade coating method and a bill blade coating method. Coating may be carried out by an off-machine coater or by an on-machine coater arranged on a paper-making machine. For obtaining excellent smoothness and surface condition by imparting fluidity at the time of blade coating, the coating liquid for forming the undercoating layer (coating liquid for undercoating layer) may include carboxymethyl cellulose having an etherification degree of 0.6 to 0.8 and a weight-average molecular weight of 20000 to 200000, in an amount of 1 to 5 mass %, preferably 1 to 3 mass %, based on the amount of the pigment described above.

When the undercoating layer is applied and formed on the support, the amount of the pigment applied is preferably in the range of 1 to 10 g/m$^2$, more preferably 1.5 to 5.0 g/m$^2$, and particularly preferably 2.0 to 4.0 g/m$^2$.

—Rp Value when Heat is Applied—

In the support having the undercoating layer, an Rp value of the undercoating layer, as measured by a microtopograph when heated at 100° C. for 5 sec, is preferably 10 or less (having flatness with an Rp value of 10 or less).

In order to control the Rp value to be 10 or less, a layer having a thermal conductivity of 0.1 W/m·K or less may be used.

[Support]

As the support, a support known in the art can be suitably selected and used, as long as it is a support whose type D durometer hardness in accordance with ISO 7619:2004 is 40 or more.

In a case where the type D durometer hardness in accordance with ISO 7619:2004 is less than 40, the thermosensitive recording material has a certain degree of pliability, and therefore the occurrence of image defects due to no color formation, surface condition defects, streaks, or the like does not readily occur.

Specific examples of the support that can be applied to the present invention include a paper support such as high-quality paper, coated paper having a pigment applied onto paper, resin-coated paper having resin applied onto paper, resin-laminated paper, high-quality paper having an undercoating layer, synthetic paper, and a transparent support such as plastic film. A support mainly including recycled pulp, that is, a support wherein recycled pulp comprises 50 mass % of the support, can also be used.

As the above-stated support, a smooth support having a smoothness of 2000 sec or more as defined by ISO 5627:1995 (JIS-P8119 (1998)), the disclosure of which is incorporated by reference herein, on the surface of the support at the side having the undercoating layer is preferable in view of dot reproducibility.

A void-containing support is more preferable, having flatness with an Rp value of 10 or less, as measured by a microtopograph when heated at 100° C. for 5 sec. In order to control the Rp value to be 10 or less, for example, a void-content ratio of the support is preferably in the range of 10 to 45%.

In the invention, the support is preferably one type selected from a transparent support, a synthetic paper and resin-coated paper.

When the support is a transparent support, a synthetic paper or a resin-coated paper, smoothness can be made especially high, particularly dot reproducibility is excellent, and when an actual image is observed with the naked eye, image quality excellent in image reproducibility in a wide region from a low-density portion to a high-density portion can be obtained. As the transparent support, for example a support such as polyester support is particularly preferable.

[Thermosensitive Color-Forming Layer]

The thermosensitive color-forming layer in the invention includes at least one electron-donating dye precursor, and at least one electron-accepting compound for thermal color formation of the electron-donating dye precursor.

If necessary, the thermosensitive color-forming layer may further include an adhesive, an image stabilizer (an ultraviolet absorber or the like), and other components.

In the invention, a compound or composition that changes at least the spectral absorbance in the visible region when thermal energy is applied is referred to as a thermosensitive color-forming component, to which the above-stated electron-donating dye precursor and electron-accepting compound for thermal color formation of the electron-donating dye precursor correspond.

As the electron-donating dye precursor and the electron-accepting compound, a known combination of an electron-donating dye precursor and an electron-accepting compound that reacts with the electron-donating dye precursor thereby forming a color can be used without particular limitation.

From the viewpoint of sensitivity and color-forming property, the thermosensitive color-forming component in the invention is a composition containing at least one electron-donating dye precursor and at least one electron-accepting compound which reacts with the electron-donating dye precursor thereby forming a color.

—Electron-Donating Dye Precursor—

The thermosensitive color-forming layer in the invention contains at least one electron-donating dye precursor. The electron-donating dye precursor can be appropriately selected from those known in the art. Examples of the electron-donating dye precursor preferably include phthalide compounds such as triphenylmethane phthalide and indolyl phthalide, fluoran compounds, phenothiazine compounds, leucoauramine compounds, rhodamine lactam compounds, triarylmethane compounds, triazene compounds, spirodipyran compounds, pyridine compounds, pyrazine compounds and fluorene compounds. The fluoran- or phthalide-based electron-donating dye precursors are particularly preferable.

Specific examples of the phthalide compounds include those described in, for example, U.S. Pat. No. 23,024 (reissued), U.S. Pat. No. 3,491,111, U.S. Pat. No. 3,491,112, U.S. Pat. No. 3,491,116 and U.S. Pat. No. 3,509,174.

Specific examples of the fluoran compounds include those described in, for example, U.S. Pat. No. 3,624,107, U.S. Pat. No. 3,627,787, U.S. Pat. No. 3,641,011, U.S. Pat. No. 3,462,828, U.S. Pat. No. 3,681,390, U.S. Pat. No. 3,920,510 and U.S. Pat. No. 3,959,571.

Specific examples of the spirodipyran compounds include those described in, for example, U.S. Pat. No. 3,971,808.

Specific examples of the pyridine compounds and pyrazine compounds include those described in, for example, U.S. Pat. No. 3,775,424, U.S. Pat. No. 3,853,869 and U.S. Pat. No. 4,246,318.

Specific examples of the fluorene compounds include those described in, for example, JP-A No. 63-94878.

Specific examples of the electron-donating dye precursor include 2-anilino-3-methyl-6-diethylaminofluoran, 2-anilino-3-methyl-6-dibutylaminofluoran, 2-anilino-3-methyl-6-(N-ethyl-N-isoamylamino)fluoran, 2-anilino-3-methyl-6-(N-ethyl-N-propylamino)fluoran, 2-anilino-3-methyl-6-di-n-amylaminofluoran, 2-anilino-3-methyl-6-(N-ethyl-N-p-tolylamino)fluoran, 2-anilino-3-methyl-6-N-ethyl-N-sec-butylaminofluoran, 3-N,N-dibutylamino-6-methyl-7-anilinofluoran, 6'-{ethyl(3-methylbutyl)amino}-3'-methyl-2'-(phenylamino)-fluoran, 3-(N-n-hexyl-N-ethylamino)-6-methyl-7-anilinofluoran, 3-[N-(3-ethoxypropyl)-N-ethylamino]-6-methyl-7-anilinofluoran, 3-di(n-butylamino)-7-(2-chloroanilino)fluoran, 3-diethylamino-7-(2-chloroanilino)fluoran, 3-(N-cyclohexyl-N-methylamino)-6-methyl-7-anilinofluoran, 2-anilino-3-methyl-6-(N-isobutyl-N-methylamino)fluoran, 2-anilino-3-methyl-6-(N-n-amyl-N-methylamino)fluoran, 2-anilino-3-methyl-6-(N-n-amyl-N-ethylamino)fluoran, 2-anilino-3-methyl-6-(N-n-propyl-N-isopropylamino)fluoran, 2-anilino-3-methyl-6-(N-methyl-N-p-toluidino)fluoran, 3-diethylamino-7,8-benzofluoran, 1,3-dimethyl-6-diethylaminofluoran, 1,3-dimethyl-6-di-n-butylaminofluoran, 3-diethylamino-7-methylfluoran, 3-diethylamino-7-chlorofluoran, 3-diethylamino-6-methyl-7-chlorofluoran, 10-diethylamino-2-ethylbenzo[1,4]thiadino[3,2-b]fluoran, 3,3-bis(1-n-butyl-2-methylindol-3-yl)phthalide, 3,3-bis(4-diethylamino-2-ethoxyphenyl)-4-azaphthalide, 3-[2,2-bis(1-ethyl-2-methyl-3-indolyl)vinyl]-3-(4-diethylaminophenyl)phthalide, and 3-[1,1-bis(4-diethylaminophenyl)ethylen-2-yl)-6-dimethylaminophthalide.

Among these compounds, it is particularly preferable to include at least one kind selected from the group consisting of 2-anilino-3-methyl-6-diethylaminofluoran, 2-anilino-3-methyl-6-dibutylaminofluoran, 2-anilino-3-methyl-6-(N-ethyl-N-isoamylamino)fluoran, 2-anilino-3-methyl-6-(N-ethyl-N-propylamino)fluoran, 2-anilino-3-methyl-6-di-n-amylaminofluoran, 3-N,N-dibutylamino-6-methyl-7-anilinofluoran, 6'-{ethyl(3-methylbutyl)amino}-3'-methyl-2'-(phenylamino)-fluoran, 2-anilino-3-methyl-6-N-ethyl-N-sec-butylaminofluoran, and 2-anilino-3-methyl-6-(N-ethyl-N-p-tolylamino)fluoran. These electron-donating dye precursors may be used individually or in a combination of two or more types in a single thermosensitive color-forming layer.

When at least one type of compound selected from the above group is contained as the electron-donating dye precursor, background fog can be kept low and color density can be increased. Image storage characteristics of an image section formed can also be further improved.

When a coating liquid for forming the thermosensitive color-forming layer (hereinafter, referred to as "coating liquid for thermosensitive color-forming layer") is prepared, the particle size of the electron-donating dye precursor is preferably 2.0 μm or less, more preferably from 0.5 μm to 1.2 μm, in terms of volume-average particle diameter. A volume-average particle diameter of 2.0 μm or less is preferable because of high thermosensitivity. A volume-average particle diameter of 0.5 μm or more is preferable for decreasing background fog. The volume-average particle diameter can be easily measured by a laser diffraction particle size distribution measuring instrument (for example, LA500 manufactured by Horiba, Ltd.) etc.

Furthermore, in the invention, the above-stated electron-donating dye precursor may be used in the form of microcapsules enclosing the dye precursor, from the viewpoints of raw stock storability (fogging prevention) of the thermosensitive color-forming layer such as prevention of contact with the electron-accepting compound at room temperature, control of the color-forming sensitivity so as to form a color at a desired thermal energy, and the like.

The microcapsules usable in the invention can be produced by any method of interfacial polymerization, internal polymerization and external polymerization. It is particularly preferable to use an interfacial polymerization method wherein a core substance containing the electron-donating dye precursor is emulsified in an aqueous solution having a water-soluble polymer dissolved therein, and then a wall of the polymer material is formed around the oil droplets. A reactant for forming the polymer material is added to the inside of oil droplets and/or the outside of oil droplets.

Specific examples of the polymer material include polyurethane, polyurea, polyamide, polyester, polycarbonate, urea-formaldehyde resin, melamine resin, polystyrene, a styrene/methacrylate copolymer and a styrene/acrylate copolymer. The polymer material is preferably polyurethane, polyurea, polyamide, polyester or polycarbonate, more preferably polyurethane and polyurea. That is, the microcapsule preferably has a polymer film wall having urethane or urea bonds. The polymer materials may also be used in a combination of two or more.

Specific examples of the above-stated water-soluble polymer may include gelatin, polyvinyl pyrrolidone, polyvinyl alcohol and the like. Details of the method for producing a microcapsule composite wall are described in, for example, JP-A No. 58-66948. In a case where the electron-donating dye precursor is enclosed in microcapsules, it is preferable that the electron-donating dye precursor is used as a solution in an organic solvent.

Such organic solvents include solvents of low-boiling point such as ethyl acetate, methyl acetate, carbon tetrachloride, chloroform, methanol, ethanol, n-butanol, dioxane, acetone and benzene, phosphates, carboxylates such as phthalate, and solvents of high-boiling point such as fatty acid amides, alkylated biphenyl, alkylated terphenyl, chlorinated paraffin, alkylnaphthalene and diarylethane. Such organic solvents are described in detail in JP-A No. 4-19778. Microcapsules containing substantially no organic solvent as shown in JP-A No. 4-101885 can also be used.

If necessary, a metal-containing dye, a charge regulator such as nigrosine, and other additives may be added to the microcapsule wall used in the invention. These additives can be added at any time point before or during formation of the wall. For regulating charging of the surface of the microcapsule wall, vinyl monomers or the like may be added and graft-polymerized.

A solid sensitizer for swelling the microcapsule wall during heating may be further added to the microcapsules encapsulating the electron-donating dye precursor. A solid sensitizer having a melting point of 50° C. or more (preferably 120° C. or less) and being solid at room temperature, selected from plasticizers for polymers used as microcapsule walls, may be used. For example, in a case where the wall material is composed of polyurea or polyurethane, a hydroxy compound, a carbamate compound, an aromatic alkoxy compound, an organic sulfonamide compound, an aliphatic amide compound, an arylamide compound or the like can be preferably used.

The amount of the electron-donating dye precursor applied is preferably in the range of 0.1 to 3.0 g/m$^2$, more preferably 0.2 to 1.5 g/m$^2$, from the viewpoint of color density and background fog.

—Electron-Accepting Compound—

The thermosensitive color-forming layer in the invention contains at least one electron-accepting compound which reacts with the electron-donating dye precursor thereby allowing the precursor to form a color. The electron-accepting compound can be suitably selected from those known in the art.

The electron-accepting compound in the invention is preferably at least one type of the compounds represented by formula (I) below. By including the compound as an electron-accepting compound, the thermosensitive color-forming layer can attain higher sensitivity with excellent image gradation reproduction while keeping background fog low and suppressing printing blurring, and can also simultaneously improve the long-term storage characteristics of a formed image (image storage characteristics), chemical resistance, ink jet suitability, and head matching property with a thermal head.

Formula (I)

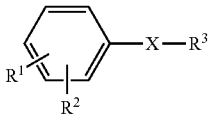

In formula (I), $R^1$ and $R^2$ each independently represent a hydrogen atom, an alkyl group, an alkenyl group, a hydroxy group, a halogen atom or —$SO_2$Ar, and $R^3$ represents —Ar, —NH—Ar or —NH—CO—NH—Ar, wherein Ar represents an aromatic ring. The aromatic ring may be substituted by at least one kind selected from a hydroxy group, an alkyl group, an alkenyl group, an alkoxy group, a halogen atom and a substituent containing —$SO_2$Ar. X represents a divalent linking group represented by any of the following:

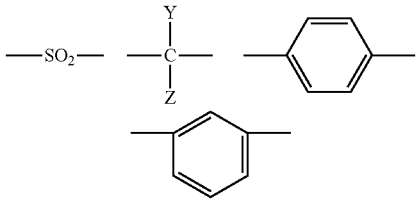

In the above formula, Y and Z each independently represent a hydrogen atom or an alkyl group, and Y and Z may be bonded to each other to form a ring. The alkyl group represented by Y or Z is preferably an alkyl group having 1 to 12 carbon atoms, and more preferably an alkyl group having 1 to 8 carbon atoms. Specific examples of the alkyl group include a methyl group, an ethyl group, a propyl group, a butyl group and a hexyl group.

At least one of $R^1$ and $R^2$ is preferably a hydroxy group.

The alkyl group represented by $R^1$ and $R^2$ is preferably an alkyl group having 1 to 4 carbon atoms, more preferably a methyl group, an ethyl group, an isopropyl group or a t-butyl group. The alkenyl group represented by $R^1$ and $R^2$ is preferably a vinyl group or an allyl group. The halogen atom represented by $R^1$ and $R^2$ is preferably a fluorine atom, a chlorine atom or a bromine atom.

The Ar is preferably a benzene ring or naphthalene ring which may have a substituent. The substituent is preferably a hydroxyl group, an alkyl group (for example, a methyl group, an ethyl group, an isopropyl group, etc.), an alkenyl group (for example, a vinyl group, an allyl group etc.), an alkoxy group (for example, a methoxy group, an ethoxy group, an isopropyloxy group, etc.), a halogen atom (for example, a fluorine atom, a chlorine atom, a bromine atom, etc.), or a substituent containing —$SO_2$Ar. Examples of the "substituent containing —$SO_2$Ar" include —$CH_2$—$C_6H_4$—NHCONH—$SO_2$—$C_6H_5$, —$CH_2$—$C_6H_4$—NHCONH—$SO_2$—$C_6H_4$—$CH_3$, —$SO_2$—$C_6H_5$, —$SO_2$—$C_6H_4$—$CH_3$, —$SO_2$—$C_6H_4$—Cl, and the like.

Preferable specific examples of the compounds represented by formula (I) as above include 2,4-bis(phenylsulfonyl)phenol, 4-hydroxybenzene sulfonanilide (=p-N-phenylsulfamoylphenol), p-N-(2-chlorophenyl)sulfamoylphenol, p-N-3-tolylsulfamoylphenol, p-N-2-tolylsulfamoylphenol, p-N-(3-methoxyphenyl)sulfamoylphenol, p-N-(3-hydroxyphenyl)sulfamoylphenol, p-N-(4-hydroxyphenyl)sulfamoylphenol, 2-chloro-4-N-phenylsulfamoylphenol, 2-chloro-4-N-(3-hydroxyphenyl)sulfamoylphenol, 4'-hydroxy-p-toluene sulfonanilide, 4,4'-bis(p-toluenesulfonylaminocarbonylamino)diphenylmethane (=BTUM), 4-hydroxy-4'-isopropoxydiphenylsulfone, 2,2'-bis(4-hydroxyphenol)propane (bisphenol A), 4-t-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidene diphenol, 4,4'-sec-butylidenediphenol, 4-tert-octylphenol, 4-p-methylphenylphenol, 4,4'-methylcylohexylidene phenol, 4,4'-isopentylidene phenol, 4-[4-(1-methylethoxy)phenylsulfonyl]phenol, 4,4'-(m-phenylenediisopropylidene)diphenol, 3,3'-diallyl-4,4'-dihydroxy biphenylsulfone and benzyl p-hydroxybenzoate.

However, the present invention is not limited thereto.

Among the electron-accepting compounds represented by the above formula (I), 2,4-bis(phenylsulfonyl)phenol, 4-hydroxybenzene sulfonanilide and 4-hydroxy-4'-isopropoxydiphenylsulfone are preferable in view of the balance between image storage characteristics and background fog.

The electron-accepting compound is also preferably any compound selected from salicylic acid derivatives and polyvalent metal salts thereof.

The salicylic acid derivatives include, for example, 4-pentadecylsalicylic acid, 3,5-di(a-methylbenzyl)salicylic acid, 3,5-di(tert-octyl)salicylic acid, 5-octadecylsalicylic acid, 5-α-(p-α-methylbenzylphenyl)ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, 4-(n-pentanoylamino)salicylic acid, 4-(n-hexanoylamino)salicylic acid, 4-(n-octanoylamino)salicylic acid, 4-(hexadecanoylamino)salicylic acid, 4-(N'-n-butylcarbamoylamino)salicylic acid, 4-(N'-n-hexylcarbamoylamino)salicylic acid, 4-(N'-n-octylcarbamoylamino)salicylic acid, 4-(N'-hexadecylcarbamoylamino)salicylic acid, 4-(n-octyloxycarbonylamino)salicylic acid, 4-(n-nonyloxycarbonylamino)salicylic acid, 4-(n-decyloxycarbonylamino)salicylic acid, 4-(n-undecyloxycarbonylamino)salicylic acid, 4-(n-dodecyloxycarbonylamino)salicylic acid, 4-(n-tridecyloxycarbonylamino)salicylic acid, 4-(n-tetradecyloxycarbonylamino)salicylic acid, 4-(n-pentadecyloxycarbonylamino)salicylic acid, 4-(n-hexadecyloxycarbonylamino)salicylic acid, 4-(n-octadecyloxycarbonylamino)salicylic acid, 3-(n-octyloxycarbonylamino)salicylic acid, 3-(n-nonyloxycarbonylamino)salicylic acid, 3-(n-decyloxycarbonylamino)salicylic acid, 3-(n-undecyloxycarbonylamino)salicylic acid, 3-(n-dodecyloxycarbonylamino)salicylic acid, 3-(n-tridecyloxycarbonylamino)salicylic acid, 3-(n-tetradecyloxycarbonylamino)salicylic acid, 3-(n-pentadecyloxycarbonylamino)salicylic acid, 3-(n-hexadecyloxycarbonylamino)salicylic acid, 3-(n-octadecyloxycarbonylamino)salicylic acid, 5-(n-octyloxycarbonylamino)salicylic acid, 5-(n-nonyloxycarbonylamino)salicylic acid, 5-(n-decyloxycarbonylamino)salicylic acid, 5-(n-undecyloxycarbonylamino)salicylic acid, 5-(n-dodecyloxycarbonylamino)salicylic acid, 5-(n-tridecyloxycarbonylamino)salicylic acid, 5-(n-tetradecyloxycarbonylamino)salicylic acid, 5-(n-pentadecyloxycarbonylamino)salicylic acid, 5-(n-hexadecyloxycarbonylamino)salicylic acid, and 5-(n-octadecyloxycarbonylamino)salicylic acid.

Polyvalent metal salts of salicylic acid derivatives include zinc, aluminum, calcium, copper or lead salts of the above salicylic acid derivatives.

The content of the electron-accepting compound in the thermosensitive color-forming layer may be from 5 to 20 times, preferably from 7 to 15 times, more preferably 9 to 12 times by mass, based on the mass of the electron-donating dye precursor in the thermosensitive color-forming layer so as to increase the sensitivity and soften the image gradation.

When the content of the electron-accepting compound is lower than 5 times, the image gradation may become hard. When the content of the electron-accepting compound exceeds 20 times, the amount of coating of the thermosensitive color-forming layer may be increased and $D_{max}$ (maximum density) may become low.

In the invention, an electron-accepting compound represented by the above formula (I) and an electron-accepting compound selected from the salicylic acid derivatives and polyvalent metal salts thereof are preferably simultaneously used.

In a case where the known electron-accepting compounds are simultaneously used, the content of the electron-accepting compound represented by the above formula (I) is preferably 50 mass % or more, more preferably 70 mass % or more, based on the total mass of the electron-accepting compounds.

In preparation of a coating liquid for forming the thermosensitive color-forming layer, the particle diameter of the electron-accepting compound is preferably 2.0 μm or less, more preferably from 0.5 μm to 1.2 μm, in terms of volume-average particle diameter. The volume-average particle diameter of 2.0 μm or less is preferable for higher thermosensitivity. The volume-average particle diameter of 0.5 μm or more is preferable because background fog hardly occurs. The volume-average particle diameter can also be easily measured by a laser diffraction particle size distribution measuring instrument (for example, LA500, manufactured by Horiba, Ltd.) or the like.

The electron-accepting compound may be dissolved in a water-poorly-soluble or water-insoluble organic solvent, then mixed with an aqueous phase containing a surfactant and a water-soluble polymer as protective colloid, and emulsified to give an emulsified dispersion. In the invention, the resulting emulsified dispersion may be used.

—Sensitizer—

The thermosensitive color-forming layer in the invention may further contain a sensitizer, in addition to the electron-donating dye precursor and the electron-accepting compound. By containing the sensitizer, sensitivity can be significantly improved. As the sensitizer in the invention, a known sensitizer can be suitably selected and used. Examples of such sensitizers include 2-benzyloxynaphthalene, dimethylbenzyl oxalate, m-terphenyl, ethylene glycol tolyl ether, p-benzylbiphenyl, 1,2-diphenoxymethylbenzene, 1,2-diphenoxyethane, diphenylsulfone, an aliphatic monoamide, aliphatic bisamide, stearyl urea, di(2-methylphenoxy)ethane, di(2-methoxyphenoxy)ethane, β-naphthol-(p-methylbenzyl) ether, α-naphthyl benzyl ether, 1,4-butanediol p-methylphenyl ether, 1,4-butanediol p-isopropylphenyl ether, 1,4-butanediol p-tert-octylphenyl ether, 1-phenoxy-2-(4-ethylphenoxy)ethane, 1-phenoxy-2-(chlorophenoxy)ethane, 1,4-butanediol phenyl ether, diethylene glycol bis(4-methoxyphenyl) ether, 1,4-bis(phenoxymethyl)benzene, and the like. These sensitizers may be used individually or in a combination of two or more types.

Among the sensitizers described above, at least one kind selected from the group consisting of 2-benzyloxynaphthalene, dimethylbenzyl oxalate, m-terphenyl, ethylene glycol tolyl ether, p-benzylbiphenyl, 1,2-diphenoxymethylbenzene, 1,2-diphenoxyethane and diphenylsulfone is particularly preferably contained in the invention.

The total content of the sensitizer in the thermosensitive color-forming layer is preferably from 75 to 200 parts by mass, more preferably from 100 to 150 parts by mass, based on 100 parts by mass of the electron-accepting compound.

When the content of the sensitizer is in the above-specified range, the effect of improving sensitivity is significant, and image storage characteristics can also be improved.

—Inorganic Pigment—

The thermosensitive color-forming layer in the invention may further contain an inorganic pigment in addition to the electron-donating dye precursor and the electron-accepting compound in such a range that the effect of the invention is not deteriorated. By containing the inorganic pigment, head matching property with a thermal head to be contacted can be further improved.

The inorganic pigment can be suitably selected from those known in the art. Particularly, at least one kind selected from calcite-based calcium carbonate, amorphous silica and aluminum hydroxide is preferably contained.

From the viewpoint of improving color density and of preventing deposits from adhering to a thermal head, the content of the inorganic pigment in the thermosensitive color-forming layer is preferably from 50 to 500 parts by mass, more preferably from 70 to 350 parts by mass, still more preferably from 90 to 250 parts by mass, based on 100 parts by mass of the electron-accepting compound.

—Adhesive—

The thermosensitive color-forming layer in the invention preferably contains an adhesive (or a protective colloid at the time of dispersion) in addition to the above-stated components. Examples of the adhesive can include polyvinyl alcohol, modified polyvinyl alcohol, a vinyl acetate-acrylamide copolymer, starch, modified starch, methyl cellulose, carboxymethyl cellulose, hydroxymethyl cellulose, gelatins, gum arabic, casein, styrene-maleic acid copolymer hydrolysates, polyacrylamide derivatives, polyvinyl pyrrolidone, and latexes such as styrene-butadiene rubber latex, acrylonitrile-butadiene rubber latex, methyl acrylate-butadiene rubber latex and vinyl acetate emulsion.

In the invention, the adhesive is particularly preferably polyvinyl alcohol, and modified polyvinyl alcohols such as sulfo-modified polyvinyl alcohol, diacetone-modified polyvinyl alcohol and acetoacetyl-modified polyvinyl alcohol can also be used. By containing the modified polyvinyl alcohol as an adhesive in the thermosensitive color-forming layer, the adhesion between the thermosensitive color-forming layer and the support can be increased, and problems such as paper peeling in offset printing can be prevented, and printing suitability can be improved. Further, color density when recording with a thermal head can further be improved while background fog is kept low.

The polyvinyl alcohols may be used individually or in a combination of two or more types or in combination with other modified polyvinyl alcohols or polyvinyl alcohols. When the other modified polyvinyl alcohols or polyvinyl alcohols are used, the content of the above-mentioned modified polyvinyl alcohol is preferably 10 mass % or more, more preferably 20 mass % or more, based on the total mass of the adhesive components.

The degree of saponification of the polyvinyl alcohol is preferably in the range of 85 to 99 mol %. When the degree of saponification is lower than 85 mol %, water resistance to dampening water used in offset printing may be insufficient. As a result, paper peeling may easily occur. When the degree of saponification is higher than 99 mol %, undissolved materials may easily be generated in preparation of the coating liquid, and generation of poor coating may occur. When the other modified polyvinyl alcohols and polyvinyl alcohols are simultaneously used, the other modified polyvinyl alcohols and polyvinyl alcohols preferably have degrees of saponification in the above-specified range in order to prevent deterioration in the effect of the invention.

The degree of polymerization of the polyvinyl alcohol is preferably in the range of 200 to 2000. When the degree of polymerization is lower than 200, paper peeling during offset printing may easily occur. When the degree of polymerization is higher than 2000, the polyvinyl alcohol does not readily dissolve in a solvent (water), and liquid viscosity at the time of preparation increases, and thus preparation and application of a coating liquid for forming the thermosensitive color-forming layer may be difficult to perform. When the other modified polyvinyl alcohols and polyvinyl alcohols are simultaneously used, the other modified polyvinyl alcohols and polyvinyl alcohols preferably have degrees of saponification in the above-specified range in order to prevent deterioration in the effect of the invention.

From the viewpoint of improving color density and of imparting offset printing suitability (prevention of paper peel, etc.), the content of the polyvinyl alcohols in the thermosensitive color-forming layer is preferably from 30 to 300 parts by mass, more preferably from 70 to 200 parts by mass, still more preferably from 100 to 170 parts by mass, based on 100 parts by mass of the electron-donating dye precursor. The polyvinyl alcohol not only functions as an adhesive for improving interlayer adhesion but also functions as a dispersant, a binder, and the like.

—Image Stabilizer—

Preferably, the thermosensitive color-forming layer in the invention further contains image stabilizers (including an ultraviolet absorber) in addition to the above-stated essential components. The ultraviolet absorber may be encapsulated into microcapsules. By containing the image stabilizer, the storage characteristics of a formed color image (image storage characteristics) can be further improved.

For example, a phenol compound, particularly a hindered phenol compound, is effective as the image stabilizer. Examples of the image stabilizer include 1,1,3-tris(2-methyl-4-hydroxy-5-tert-butylphenyl)butane, 1,1,3-tris(2-methyl-4-hydroxy-5-cyclohexylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), 4,4'-thio-bis(3-methyl-6-tert-butylphenol), etc. The image stabilizers may be used individually or in a combination of two or more types.

Among these compounds, 1,1,3-tris(2-methyl-4-hydroxy-5-tert-butylphenyl)butane and 1,1,3-tris(2-methyl-4-hydroxy-5-cyclohexylphenyl)butane are particularly preferable.

From the viewpoint of preventing background fog and of effectively improving image storage characteristics, the total content of the image stabilizer in the thermosensitive color-forming layer is preferably from 10 to 100 parts by mass, more preferably from 20 to 60 parts by mass, based on 100 parts by mass of the electron-donating dye precursor. When 1,1,3-tris(2-methyl-4-hydroxy-5-tert-butylphenyl)butane and/or 1,1,3-tris(2-methyl-4-hydroxy-5-cyclohexylphenyl) butane are used in combination with the other image stabilizers described above, the content of 1,1,3-tris(2-methyl-4-hydroxy-5-tert-butylphenyl)butane and/or 1,1,3-tris(2-methyl-4-hydroxy-5-cyclohexylphenyl)butane in the single thermosensitive color-forming layer is preferably 50 mass % or more, more preferably 70 mass % or more, based on the total mass of the image stabilizers.

Examples of the ultraviolet absorber can include the ultraviolet-absorbing compounds shown below.

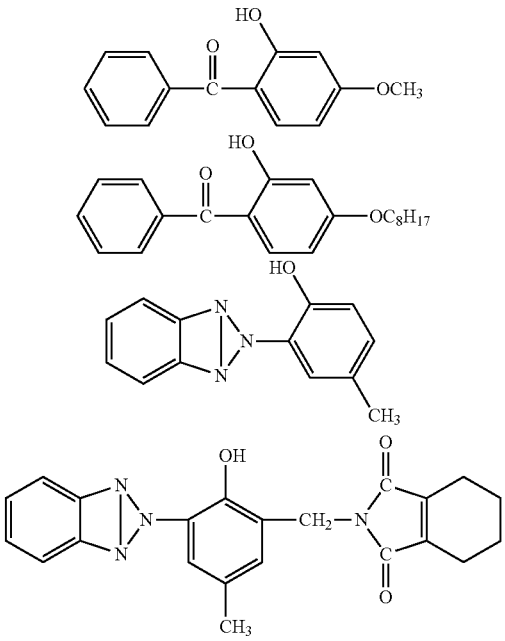

-continued

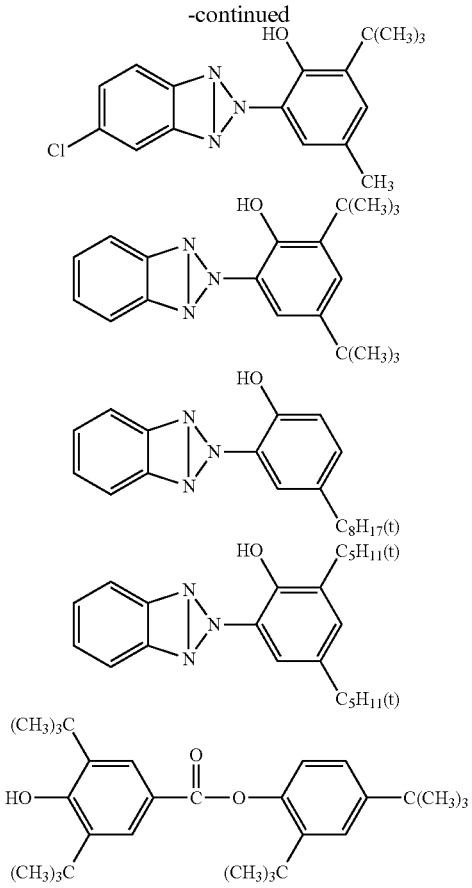

From the viewpoint of effectively improving image storage characteristics, the content the ultraviolet absorber in a single thermosensitive color-forming layer is preferably from 10 to 300 parts by mass, more preferably from 30 to 200 parts by mass, based on 100 parts by mass of the electron-donating dye precursor.

—Other Components—

Depending on the object and necessity, the thermosensitive color-forming layer in the invention may also contain other components such as a crosslinking agent, a mordant, a metal soap, wax, a surfactant, an antistatic agent, a defoaming agent and a fluorescent dye, in addition to the components described above.

—Crosslinking Agent—

The thermosensitive color-forming layer may also contain a crosslinking agent acting on the modified polyvinyl alcohol or the like used as the adhesive (or protective colloid). By containing the crosslinking agent, water resistance of the thermosensitive recording material can be improved. The crosslinking agent can be suitably selected from those capable of crosslinking the modified polyvinyl alcohol. An aldehyde compound such as glyoxal or a dihydrazide compound such as adipic acid dihydrazide is particularly preferable as the crosslinking agent. The content of the crosslinking agent in the thermosensitive color-forming layer is preferably from 1 to 50 parts by mass, more preferably from 3 to 20 parts by mass, based on 100 parts by mass of the modified polyvinyl alcohol or the like as the object of cross-linkage. When the content of the crosslinking agent is in the above-specified range, water resistance can be effectively improved.

—Metal Soap, Wax and Surfactant—

Examples of the metal soap include higher fatty acid metal salts. Specific examples thereof include zinc stearate, calcium stearate, aluminum stearate, and the like. Examples of the wax include, for example, paraffin wax, microcrystalline wax, carnauba wax, methylol stearoamide, polyethylene wax, polystyrene wax, and fatty acid amide-based wax. These waxes may be used individually or in a combination of two or more types. Examples of the surfactant include, for example, a sulfosuccinic acid-based alkali metal salt, a fluorine-containing surfactant, and the like.

[Formation of Thermosensitive Color-Forming Layer]

When the thermosensitive color-forming layer in the thermosensitive recording material of the invention contains an electron-donating dye precursor, an electron-accepting compound, an inorganic pigment, an adhesive and a sensitizer, these components are subjected simultaneously or separately to dispersion using a stirrer/pulverizer such as a ball mill, an attritor or a sand mill and can be prepared as a coating liquid. If necessary, the above-stated other components, that is, a crosslinking agent, a mordant, a metal soap, wax, a surfactant, a binder, an antistatic agent, a defoaming agent and a fluorescent dye are added to the coating liquid.

A coating liquid is prepared as mentioned above, and the coating liquid is coated on the surface of the undercoating layer to form a thermosensitive color-forming layer. The coating method for coating the coating liquid is not specifically limited, and may be appropriately selected from coating methods using, for example, an air knife coater, a roll coater, a blade coater, a curtain coater, a wire bar or the like, and the coating liquid is then dried after the coating. After the drying, the coating is preferably smoothed by calendar treatment, and subjected to use. The dry coating amount of the coating liquid for coating the thermosensitive color-forming layer is preferably lower than 12 g/m$^2$, and more preferably 10 g/m$^2$ or less.

In the invention, a curtain coating method of using a curtain coater is particularly preferable in that high density (high sensitivity) can be achieved with a smaller amount of the materials used, and simultaneously image quality can also be improved. When a protective layer or the like is also provided in addition to the thermosensitive color-forming layer as described later, plural layers are simultaneously applied in the form of a multilayer by the curtain coating method, whereby the consumption of energy at the time of production can be further reduced. This can be carried out specifically in the following manner.

The thermosensitive recording material is produced preferably by curtain coating plural coating liquids for a part or all of layers to be provided on a support onto the surface of the support and then drying. The type of layer formed by curtain coating is not particularly limited. Examples of the type of layer include, for example, an undercoating layer, a thermosensitive color-forming layer, a protective layer, and the like. It is also a preferable embodiment that a series of these adjacent layers are simultaneously applied in the form of a multilayer by curtain coating.

Specific combinations of layers in the case of simultaneous multilayer coating include, but are not limited to, a combination of the undercoating layer and the thermosensitive color-forming layer, a combination of the thermosensitive color-forming layer and the protective layer, a combination of the undercoating layer, the thermosensitive color-forming layer and the protective layer, a combination of two or more of different undercoating layers, a combination of two or more of different thermosensitive color-forming layers, and a combination of two or more of different protective layers.

The curtain coater used in curtain coating is not particularly limited. Examples of the curtain coater include, for example, an extrusion hopper type curtain coater and a slide hopper type curtain coater. Among these curtain coaters, a slide hopper type curtain coater, described in JP-B No. 49-24133, that is used in producing a photographic photosensitive material is particularly preferable. Simultaneous multilayer coating can be easily carried out by using this slide hopper type curtain coater.

[Protective Layer]

In the invention, at least one protective layer is preferably arranged on the thermosensitive color-forming layer, from the viewpoint of image storage characteristics and head matching property. The protective layer can be constructed by containing an organic or inorganic fine powder, a binder, a surfactant, a thermoplastic substance, and the like. Examples of the fine powder include, for example, an inorganic fine powder such as calcium carbonate, silicas, zinc oxide, titanium oxide, aluminum hydroxide, zinc hydroxide, barium sulfate, kaolin, clay, talc, and surface-treated calcium, or silica, and an organic fine powder such as a urea-formalin resin, a styrene/methacrylic acid copolymer, or polystyrene.

Examples of the binder to be incorporated in the protective layer include polyvinyl alcohol, modified polyvinyl alcohol, vinyl acetate-acrylamide copolymer, silicon-modified polyvinyl alcohol, starch, modified starch, methyl cellulose, carboxymethyl cellulose, hydroxymethyl cellulose, gelatins, gum arabic, casein, hydrolysates of styrene-maleic acid copolymer, polyacrylamide derivatives, polyvinyl pyrrolidone, latexes such as styrene-butadiene rubber latex, acrylonitrile-butadiene rubber latex, methyl acrylate-butadiene rubber latex and vinyl acetate emulsion, and the like.

Furthermore, an embodiment in which a waterproofing agent is added so that the binder component in the protective layer is crosslinked to further improve the storage stability of the thermosensitive recording material is also preferable. Examples of the waterproofing agent include water-soluble initial condensates such as N-methylolurea, N-methylolmelamine and urea-formalin; dialdehyde compounds such as glyoxal and glutaraldehyde; inorganic crosslinking agents such as boric acid, borax, colloidal silica and Zr salts; polyamide epichlorohydrin; and the like.

It is a particularly preferable embodiment that the protective layer contains a water-soluble polymer and at least one inorganic pigment selected from aluminum hydroxide, kaolin and amorphous silica. By constituting the protective layer in this embodiment, storage characteristics can be improved and simultaneously handleability and printing suitability can also be imparted. The protective layer may also contain a surfactant, a thermofusible substance, and the like.

The volume-average particle diameter of the inorganic pigment contained in the protective layer is preferably in the range of 0.5 to 3 μm, more preferably 0.7 to 2.5 μm. Measurement of the volume-average particle diameter can be carried out in the same manner as in the electron-donating dye precursor, etc.

The total content of the inorganic pigment selected from aluminum hydroxide, kaolin and amorphous silica is preferably in the range of 10 to 90 mass %, and more preferably 30 to 70 mass %, based on the total solid content (mass) of the coating liquid for forming the protective layer. Further, other pigments such as barium sulfate, zinc sulfate, talc, clay and colloidal silica may be used in combination to the extent that the effect of the invention is not deteriorated.

Examples of the water-soluble polymer include, among the above-stated binders, polyvinyl alcohol and modified polyvinyl alcohol (hereinafter referred to collectively as "polyvinyl alcohol"), starch and modified starch such as oxidized starch and urea phosphate starch, and carboxyl group-containing polymers such as a styrene-maleic anhydride copolymer, a styrene-maleic anhydride copolymer alkyl ester, and a styrene-acrylic acid copolymer. Particularly from the viewpoint of printing suitability, polyvinyl alcohol, oxidized starch, and urea phosphate starch are preferable and are particularly preferably used in a mixture such that the mass ratio (x/y) of polyvinyl alcohol (x) to oxidized starch and/or urea phosphate starch (y) is in the range of 90/10 to 10/90. Particularly, when all of the polyvinyl alcohol, oxidized starch and urea phosphate starch are used at the same time, the mass ratio ($y^1/y^2$) of oxidized starch ($y^1$) to urea phosphate starch ($y^2$) is preferably in the range of 10/90 to 90/10.

The modified polyvinyl alcohol is preferably acetoacetyl-modified polyvinyl alcohol, diacetone-modified polyvinyl alcohol, silicon-modified polyvinyl alcohol, amide-modified polyvinyl alcohol, or alkylether-modified polyvinyl alcohol, and besides, sulfo-modified polyvinyl alcohol, carboxy-modified polyvinyl alcohol, and the like are used. When a crosslinking agent that reacts with these polyvinyl alcohols is simultaneously used, storage characteristics, handleability and printing suitability can be further improved.

The content ratio of the water-soluble polymer is preferably in the range of 10 to 90 mass %, more preferably 30 to 70 mass %, based on the total solid content (mass) of the coating liquid for forming the protective layer.

Preferable examples of the crosslinking agent for crosslinking the water-soluble polymer include polyvalent amine compounds such as ethylenediamine, polyvalent aldehyde compounds such as glyoxal, glutaraldehyde and dialdehyde, dihydrazide compounds such as adipic acid dihydrazide and phthalic acid dihydrazide, water-soluble methylol compounds (urea, melamine, phenol), multifunctional epoxy compounds, polyvalent metal salts (Al, Ti, Zr, Mg, etc.), and the like. In particular, polyvalent aldehyde compounds and dihydrazide compounds are preferable.

The content ratio of the crosslinking agent is preferably in the range of about 2 to 30 mass %, and more preferably 5 to 20 mass %, based on the mass of the water-soluble polymer. By containing the crosslinking agent, film strength, water resistance and the like can be further improved. Although the mixing ratio of the inorganic pigment (selected from aluminum hydroxide, kaolin and amorphous silica) to the water-soluble polymer in the protective layer varies depending on the type and particle diameter of the inorganic pigment, the type of the water-soluble polymer, and the like, the amount of the water-soluble polymer is preferably in the range of 50 to 400 mass %, more preferably 100 to 250 mass %, based on the mass of the inorganic pigment. The total mass of the inorganic pigment and the water-soluble polymer in the protective layer is preferably 50 mass % or more of the total mass of solids of the protective layer.

Preferable examples of the surfactant include alkylbenzene sulfonates such as sodium dodecylbenzenesulfonate, alkyl sulfosuccinates such as sodium dioctylsulfosuccinate, polyoxyethylene alkyl ether phosphates, sodium hexametaphosphate, perfluoroalkyl carboxylates, and the like. Among them, alkyl sulfosuccinates are more preferable. The content ratio of the surfactant is preferably 0.1 to 5 mass %, more preferably 0.5 to 3 mass %, based on the total solid content (mass) of the coating liquid for forming the protective layer.

A coating liquid for forming the protective layer can be prepared by dissolving or dispersing the inorganic pigment selected from aluminum hydroxide, kaolin and amorphous silica, the water-soluble polymer, and if necessary, a crosslinking agent, a surfactant, etc., described above in a desired aqueous solvent. A lubricant, a defoaming agent, a fluorescent brightener, a colored organic pigment, and the like can be added to the coating liquid in such a range that the effect of the invention is not deteriorated. Examples of the lubricant include, for example, metal soap such as zinc stearate and calcium stearate, wax such as paraffin wax, microcrystalline wax, carnauba wax and synthetic polymer wax, and the like.

The total ion concentration of monovalent ion such as $Na^+$ ion, $K^+$ ion, or the like that is possessed by the thermosensitive recording material is preferably 1500 ppm or less, more preferably 1000 ppm or less, and specifically preferably 800 ppm or less, from the viewpoint of preventing head corrosion of the thermal head that contacts with the thermosensitive recording material. The ion concentration of the above-stated $Na^+$ ion, $K^+$ ion or the like may be measured by measuring the ion mass by an ion quantitative analysis method in which the thermosensitive recording material is extracted with hot water and the extracted water is subjected to atomic absorption spectrometry. The total ion concentration is represented by ppm with respect to the total mass of the thermosensitive recording material.

According to the invention, for example, the following embodiments <1> to <9> are provided.

<1> A thermosensitive recording material comprising, on a support having a type D durometer hardness of 40 or more as defined in accordance with ISO 7619:2004, and sequentially from the support side, an undercoating layer having a dynamic microhardness at 25° C. of 5.0 mN or less; and a thermosensitive color-forming layer containing an electron-donating dye precursor and an electron-accepting compound for thermal color-formation of the electron-donating dye precursor.

<2> The thermosensitive recording material according to <1>, wherein the smoothness on the surface of the support at the side having the undercoating layer, as defined in accordance with ISO 5627:1995, is 2,000 sec or more.

3. The thermosensitive recording material according to <1> or <2>, wherein the undercoating layer contains polymer particles and a binder.

<4> The thermosensitive recording material according to <1> or <2>, wherein the undercoating layer contains hollow particles having a particle diameter of 0.5 μm or greater.

<5> The thermosensitive recording material according to <1> or <2>, wherein the undercoating layer contains a pigment and polymer particles.

<6> The thermosensitive recording material according to any one of <1> to <5>, wherein the coating amount of the undercoating layer is from 1 to 10 $g/m^2$.

<7> The thermosensitive recording material according to any one of <1> to <6>, wherein the support is a transparent support, a synthetic paper, or a resin-coated paper.

<8> The thermosensitive recording material according to any one of <1> to <7>, wherein the Rp value of the support, as measured by a microtopograph when heated at 100° C. for 5 sec, is 10 or less.

<9> The thermosensitive recording material according to any one of <1> to <7>, wherein the Rp value of the undercoating layer on the support, as measured by a microtopograph when heated at 100° C. for 5 sec, is 10 or less.

Accordingly, the present invention can provide a thermosensitive recording material which is capable of inhibiting and reducing the occurrence of image defects due to a lack of color formation, resulting from trapping of foreign matter between the thermal head and recording material, surface condition defects due to contamination of the thermal head, and streaks due to trapping of foreign matter.

EXAMPLES

Hereinafter, the present invention will be described in more detail with reference to Examples, but the invention is not limited to the specific examples given below. The "part(s)" refers to "part(s) by mass" and "%" refers to "% by mass" unless specifically indicated.

Example 1

[Preparation of Coating Liquid for Undercoating Layer]

100 parts of SBR latex (polymer particles, SN-307: manufactured by Sumitomo Naugatuck Co., Ltd.) with a concentration of 45%, 50 parts of polyvinyl alcohol ("binder", trade name: PVA-117, manufactured by Kuraray Co., Ltd.) with a concentration of 5%, and 2.0 parts of a 2% aqueous solution of sodium (2-ethylhexyl)sulfosuccinate were mixed to prepare an undercoating liquid (1).

[Preparation of Undercoating Layer Coated Support]

A void-containing PET support (CRISPER-K2312, manufactured by Toyobo Co., Ltd.) having a thickness of 50 μm was used as a support. The undercoating liquid (1) was applied on the surface of the support using a wire bar so that the post-drying coating amount would become 4.0 g/m$^2$, followed by drying in an oven at 50° C. to give an undercoating layer coated support (1). The support had a type D durometer hardness of 66 as defined in accordance with ISO 7619:2004, and a smoothness of 6677 sec as defined in accordance with ISO 5627:1995.

[Preparation of Electron-Donating Dye Precursor Dispersion Liquid]

20 parts of 3-N,N-dibutylamino-6-methyl-7-anilinofluoran were mixed with 80 parts of a 5% aqueous solution of polyvinyl alcohol (PVA-105, manufactured by Kuraray Co., Ltd.). The mixture was milled with a sand mill to prepare an electron-donating dye precursor dispersion liquid (A) having a volume-average particle diameter of 0.6 μm. The volume average-particle diameter was measured using a laser diffraction particle size distribution measuring instrument (LA500, manufactured by Horiba, Ltd.).

[Preparation of Sensitizer Dispersion Liquid]

20 parts of 1,2-bis(3-methylphenoxy)ethane were mixed with 70 parts of a 5% aqueous solution of polyvinyl alcohol (PVA-105). The mixture was milled with a sand mill to prepare a sensitizer dispersion liquid having a volume average-particle diameter of 0.6 μm. The volume average-particle diameter was measured using a laser diffraction particle size distribution measuring instrument (LA500, manufactured by Horiba, Ltd.).

[Preparation of Color-Forming Agent Dispersion Liquid]

20 parts of 2,4-bis(phenylsulfonyl)phenol were mixed with 70 parts of a 5% aqueous solution of polyvinyl alcohol (PVA-105). The mixture was milled with a sand mill to prepare a color-forming agent dispersion liquid (A) having a volume average-particle diameter of 0.6 μm. The volume average-particle diameter was measured using a laser diffraction particle size distribution measuring instrument (LA500, manufactured by Horiba, Ltd.).

[Preparation of Coating Liquid for Thermosensitive Color-Forming Layer]

3 parts of the electron-donating dye precursor dispersion liquid (A), 1 part of the sensitizer dispersion liquid, 30 parts of the color-forming agent dispersion liquid (A), 0.8 parts of HYDRIN Z-7 (manufactured by Chukyo Yushi Co., Ltd.) with a concentration of 31%, 0.8 parts of HYDRIN D337 (manufactured by Chukyo Yushi Co., Ltd.) with a concentration of 31%, 1.0 parts of a 2% aqueous solution of sodium (2-ethylhexyl)sulfosuccinate and 9 parts of water were mixed to give a coating liquid for thermosensitive color-forming layer (1).

[Preparation of Thermosensitive Recording Material]

The coating liquid for thermosensitive color-forming layer (1) was coated using a wire bar on the surface of the undercoating layer of the undercoating layer coated support (1) so that the mass of the thermosensitive color-forming layer after drying would become 6.0 g/m$^2$, dried in an oven at 50° C. and subjected to calendar treatment to give a thermosensitive recording material (1).

Example 2

[Preparation of Coating Liquid for Protective Layer]

50 parts of polyvinyl alcohol (EP-130, manufactured by Denki Kagaku Kogyo Kabushiki Kaisha) with a concentration of 5%, 0.8 parts of HYDRIN Z-7 (manufactured by Chukyo Yushi Co., Ltd.) with a concentration of 31%, 0.8 parts of HYDRIN D337 (manufactured by Chukyo Yushi Co., Ltd.) with a concentration of 31%, 2.5 parts of zirconium sulfate with a concentration of 1% and 30 parts of water were mixed to give a coating liquid for a protective layer.

[Preparation of Undercoating Layer Coated Support]

An undercoating layer coated support (2) was obtained in the same manner as in Example 1, except that SBR latex was changed to JURYMER ET410 (manufactured by Nihon Junyaku Co., Ltd.), and the post-drying coating amount was to be 4.0 g/m$^2$, in the preparation of the undercoating liquid (1) of Example 1.

[Preparation of Thermosensitive Recording Material]

The coating liquid for thermosensitive color-forming layer (1) was applied on the surface of the undercoating layer coated support (2) using a wire bar so that the post-drying mass of the thermosensitive color-forming layer would become 8.0 g/m$^2$, followed by drying in an oven at 50° C. to form a thermosensitive color-forming layer. The coating liquid for the protective layer was applied on the thermosensitive color-forming layer so that the post-drying mass of the protective layer would become 2.0 g/m$^2$, followed by drying in an oven at 50° C. and calendar treatment to obtain a thermosensitive recording material (2).

Example 3

A thermosensitive recording material (3) was obtained in the same manner as in Example 1, except that the support was changed to a 75 μm transparent PET support, the SBR latex was changed to hollow particles (Hollow Plastic Pigment HPP-055, manufactured by CMKOR Co., Ltd.), and the post-drying coating amount of the undercoating layer was 2.0 g/m$^2$. The support had a type D durometer hardness of 84 as defined in accordance with ISO 7619:2004, and a smoothness of 12300 sec as defined in accordance with ISO 5627:1995.

Example 4

A thermosensitive recording material (4) was obtained in the same manner as in Example 2, except that the support was changed to a resin-coated paper support (20 g of polyethylene had been laminated on both surfaces of 80 g base paper), JURYMER ET410 was changed to hollow particles SX866 (B) (manufactured by JSR), and the post-drying coating amount of the undercoating layer was 8.0 g/m$^2$. The support had a type D durometer hardness of 45 as defined in accordance with ISO 7619:2004, and a smoothness of 2350 sec as defined in accordance with ISO 5627:1995.

Example 5

[Preparation of Undercoating Liquid]

20 parts of SBR latex (polymer particles, SN-307: Sumitomo Naugatuck Co., Ltd.) with a concentration of 45%, 50 parts of a calcium carbonate dispersion (pigment, trade name: BRILLIANT 15S, manufactured by Shiraishi Kogyo Kaisha, Ltd.) with a concentration of 45%, and 2.0 parts of a 2% aqueous solution of sodium (2-ethylhexyl)sulfosuccinate were mixed to prepare an undercoating liquid (5).

[Preparation of Undercoating Layer Coated Support]

A void-containing polypropylene (CARLE SMR80, manufactured by Chisso Corporation) having a thickness of 80 μm was used as a support. The undercoating liquid (5) was applied on the surface of the support using a wire bar so that the post-drying mass of the coating would become 5.0 g/m$^2$, followed by drying in an oven at 50° C. to give an undercoating layer coated support (5). The support had a type D durometer hardness of 60 as defined in accordance with ISO 7619:2004, and a smoothness of 8040 sec as defined in accordance with ISO 5627:1995.

[Preparation of Color-Forming Agent Dispersion Liquid]

20 parts of 4-[4-(1-methylethoxy)phenylsulfonyl]phenol (trade name: D-8, manufactured by Nippon Soda Co., Ltd.) and 70 parts of a 5% aqueous solution of polyvinyl alcohol (PVA-105) were mixed. The mixture was milled using a sand mill to prepare a color-forming agent dispersion liquid (B) having an average particle diameter of 0.6 μm.

[Preparation of Coating Liquid for Thermosensitive Color-Forming Layer]

A coating liquid for thermosensitive color-forming layer (5) was obtained in the same manner as in Example 1, except that 30 parts of the color-forming agent dispersion liquid (B) were used in place of the color-forming agent dispersion liquid (A) in the preparation of the coating liquid for thermosensitive color-forming layer (1) in Example 1.

[Preparation of Thermosensitive Recording Material]

The coating liquid for the thermosensitive color-forming layer (5) and the coating liquid of Example 2 for the protective layer were sequentially applied using a wire bar on the surface of the undercoating layer coated support (5) so that the post-drying mass of the thermosensitive color-forming layer would be 7.0 g/m$^2$ and the post-drying mass of the protective layer would become 2.0 g/m$^2$, followed by drying in an oven at 50° C. and calendar treatment to give a thermosensitive recording material (5).

Example 6

<Preparation of Electron-Donating Dye Precursor-Enclosed Microcapsule Liquid>

14 g of 2-anilino-3-methyl-6-N-ethyl-N-sec-butylaminofluoran as an electron-donating dye precursor, 0.6 g of TINUVIN P (manufactured by Ciba Geigy Corporation) as an ultraviolet absorber, and 10 g of TAKENATE D-110N (manufactured by Takeda Pharmaceutical Company, Ltd.) and 10 g of SUMIJUL N3200 (manufactured by Sumitomo Chemical Co., Ltd.) as a capsule wall agent were dissolved in 20 g of ethyl acetate. The resulting solution was mixed with 112 g of a 5% aqueous solution of polyvinyl alcohol (trade name: PVA217C, manufactured by Kuraray Co., Ltd.). The mixture was emulsified using an ACE HOMOGENIZER (manufactured by Nippon Seiki Co., Ltd.) at 8000 rpm for 5 minutes, and then 142 g of water was further added thereto, followed by reaction at 55° C. for 3 hours to prepare an electron-donating dye precursor-enclosed microcapsule liquid having a capsule size of 0.7 μm.

<Preparation of Color-Forming Agent Emulsion Dispersion>

7 g of color-forming agent (a), 7 g of color-forming agent (b), 16 g of color-forming agent (c) and 11 g of color-forming agent (d), each being represented by the following structural formulae, 1.7 g of tricresyl phosphate, and 0.8 g of diethyl maleate were dissolved in 38 g of ethyl acetate. The resulting color-forming agent solution was mixed with an aqueous solution of 100 g of an 8% aqueous solution of polyvinyl alcohol (PVA205C, manufactured by Kuraray Co., Ltd.), 150 g of water and 0.5 g of sodium dodecylbenzenesulfonate, and the mixture was emulsified using an ACE HOMOGENIZER (manufactured by Nippon Seiki Co., Ltd.) at 10,000 rpm and room temperature for 5 minutes to obtain a color-forming agent emulsified dispersion having an average particle diameter of 1.0 μm.

Color-forming agent (a)

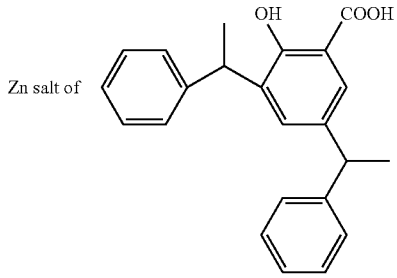

Color-forming agent (b)

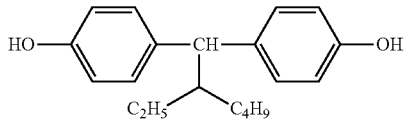

Color-forming agent (c)

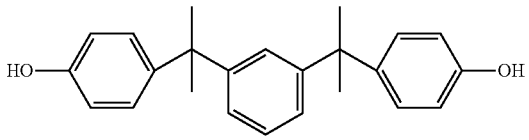

Color-forming agent (d)

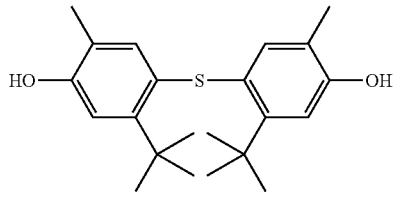

<Preparation of Thermosensitive Recording Material>

<Formation of Thermosensitive Color-Forming Layer>

5.0 parts of the electron-donating dye precursor-enclosed microcapsule liquid and 40.0 parts of the color-forming agent emulsified dispersion were mixed under stirring to prepare a coating liquid for a thermosensitive color-forming layer. The coating liquid was applied on one surface of the undercoating layer coated support (1) of Example 1 so that the amount of solids (post-drying coating amount) would become 10 g/m$^2$, followed by drying to form the thermosensitive color-forming layer.

<Formation of Protective Layer>

—Preparation of Pigment Dispersion—

15 parts of aluminum hydroxide treated with zinc stearate (trade name: HIGILITE H42S, manufactured by Showa Denko K. K.) were added to 60 parts of water, 5 parts of 10% polyvinyl alcohol (trade name: PVA205, manufactured by Kuraray Co., Ltd.) and 2 parts of 2% sodium dodecylbenzene sulfonate, and dispersed so that the average particle diameter thereof would become 0.7 μm to give a pigment dispersion.

A coating liquid for a protective layer was prepared so as to have the following composition based on the solid content, and applied on the thermosensitive color-forming layer so that the amount of solids (post-drying coating amount) would become 2.5 g/m$^2$, followed by drying to form a protective layer.

Polyvinyl alcohol: 7 parts
(trade name: PVA124, manufactured by Kuraray Co., Ltd.)

The pigment dispersion obtained above: 12 parts

Paraffin wax emulsion: 0.9 parts
(trade name: CEROZOLE 428, manufactured by Chukyo Yushi Co., Ltd.)

Zinc stearate emulsion: 0.2 parts
(trade name: HIGHMICRON F115, manufactured by Chukyo Yushi Co., Ltd.)

Polyoxyethylene alkyl ether phosphate: 0.05 parts
(trade name: NEOSCORE CM57, manufactured by Toho Chemical Industry Co., Ltd.)

Example 7

A thermosensitive recording material was obtained in the same manner as in Example 1, except that the support was changed to a void-containing polypropylene support having a thickness of 80 μm (YUPO FGS, manufactured by YUPO CORPORATION). The support had a type D durometer hardness of 50 as defined in accordance with ISO 7619:2004, and a smoothness of 8169 sec as defined in accordance with ISO 5627:1995.

Example 8

A thermosensitive recording material was obtained in the same manner as in Example 3, except that the support was changed to a void-containing polypropylene support having a thickness of 70 μm (TOYOPEARL SS, manufactured by Toyobo Co., Ltd.). The support had a type D durometer hardness of 55 as defined in accordance with ISO 7619:2004, and a smoothness of 2055 sec as defined in accordance with ISO 5627:1995.

Example 9

A thermosensitive recording material was obtained in the same manner as in Example 4, except that the support was changed to a void-containing polypropylene support having a thickness of 70 μm (CARLE TNR70, manufactured by Chisso Corporation). The support had a type D durometer hardness of 65 as defined in accordance with ISO 7619:2004, and a smoothness of 4036 sec as defined in accordance with ISO 5627:1995.

Comparative Example 1

A thermosensitive recording material was obtained in the same manner as in Example 1, except that the undercoating layer was not formed.

Comparative Example 2

A thermosensitive recording material was obtained in the same manner as in Example 1, except that a 5.0% PVA aqueous solution containing PVA alone was used as the undercoating liquid for forming an undercoating layer.

Comparative Example 3

A thermosensitive recording material was obtained in the same manner as in Example 3, except that the undercoating layer was not formed.

Comparative Example 4

A thermosensitive recording material was obtained in the same manner as in Example 4, except that the undercoating layer was not formed.

Comparative Example 5

A thermosensitive recording material was obtained in the same manner as in Example 5, except that the undercoating layer pigment was changed to SNOWTEX O (manufactured by Nissan Chemical Industries Co., Ltd.).

Comparative Example 6

A thermosensitive recording material was obtained in the same manner as in Example 6, except that the undercoating layer was not formed.

Comparative Example 7

A thermosensitive recording material was obtained in the same manner as in Example 7, except that the undercoating layer was not formed.

Comparative Example 8

A thermosensitive recording material was obtained in the same manner as in Example 8, except that the undercoating layer was not formed.

Comparative Example 9

A thermosensitive recording material was obtained in the same manner as in Example 9, except that the undercoating layer was not formed.

[Evaluation]

(Evaluation of Dynamic Microhardness of Undercoating Layer)

For samples in which an undercoating layer was formed, the dynamic microhardness at 25° C. [when an indented depth when a load P (g weight) is applied to a triangular pyramid indenter with an apical angle of 115 degrees is taken as D (μm), a dynamic microhardness $DH=37.838P/D^2$] was measured by using a dynamic ultra-microhardness tester (DUH-200) manufactured by Shimadzu Corporation.

(Measurement of Rp Value).

The Rp value of the undercoating layer coated support to be used when heated at 100° C. for 5 sec was measured using a microtopograph (manufactured by Toyo Seiki Seisaku-sho, Ltd.).

When measuring the Rp value, a hot plate is used as a heater. The temperature of the heater is set to 100° C. and the undercoating layer coated support is heated for 5 sec. The Rp value (mean value of n=5) was obtained by pressing a 5.5 cmϕ pressure contactor under 5 kg/cm$^2$ for a contact time of 990 ms against the surface of the undercoating layer opposite to the surface thereof in contact with the support in the heated undercoating layer coated support, using a surface tester "microtopograph" (Toyo Seiki Seisaku-sho, Ltd.). On the other hand, in the case of Comparative Example where the undercoating layer was not provided, the Rp value was measured by heating a support and pressing the pressure contactor against the surface of the support at the side where the thermosensitive color-forming layer is to be disposed.

(Evaluation of White Deletion)

50 μm glass beads were attached to the surface of a thermosensitive recording material, gray images were printed thereon using a thermal imager FTI500 (manufactured by FUJIFILM Corporation), and the area of resulting white deletion was measured.

(Actual Machine Evaluation)

Using a thermal imager FTI500 (manufactured by FUJIFILM Corporation), 100 actual images were printed on the obtained thermosensitive recording materials, and numbers of white deletion (0.1 mm$^2$ or more) and white streaks were evaluated.

(Evaluation of Actual Images)

Gray images (OD=0.5) were printed on the obtained thermosensitive recording materials using a thermal imager FTI500 (manufactured by FUJIFILM Corporation), and the images (gray images) were visually observed. The obtained results are shown in Table 1. The evaluation criteria are as follow.

A: uniform and smooth image

B: slight unevenness in image density

C: significant unevenness in image density with white deletion portions

Reference Example 1

[Preparation of Electron-Donating Dye Precursor Dispersion Liquid]

20 parts of 3-N,N-dibutylamino-6-methyl-7-anilinofluoran were mixed with 80 parts of a 5% aqueous solution of polyvinyl alcohol (PVA-105, manufactured by Kuraray Co., Ltd.). The mixture was milled with a sand mill to prepare an electron-donating dye precursor dispersion liquid (BA) having a volume-average particle diameter of 0.6 μm. The volume average-particle diameter was measured using a laser diffraction particle size distribution measuring instrument (LA500, manufactured by Horiba, Ltd.).

[Preparation of Sensitizer Dispersion Liquid]

20 parts of 1,2-bis(3-methylphenoxy)ethane were mixed with 70 parts of a 5% aqueous solution of polyvinyl alcohol (PVA-105). The mixture was milled with a sand mill to prepare a sensitizer dispersion liquid (B) having a volume average-particle diameter of 0.6 μm. The volume average-particle diameter was measured using a laser diffraction particle size distribution measuring instrument (LA500, manufactured by Horiba, Ltd.).

[Preparation of Color-Forming Agent Dispersion Liquid]

20 parts of 2,4-bis(phenylsulfonyl)phenol were mixed with 70 parts of a 5% aqueous solution of polyvinyl alcohol (PVA-105). The mixture was milled with a sand mill to prepare a color-forming agent dispersion liquid (BA) having a volume average-particle diameter of 0.6 μm. The volume average-particle diameter was measured using a laser diffraction particle size distribution measuring instrument (LA500, manufactured by Horiba, Ltd.).

[Preparation of Coating Liquid for Thermosensitive Color-Forming Layer]

TABLE 1

| | Undercoating layer | | Support | | | | | Number | |
|---|---|---|---|---|---|---|---|---|---|
| | Dynamic microhardness (mN) | Post-drying coating amount (g/m$^2$) | Hardness | Smoothness (sec) | Rp value (100° C.) | Area of white deletion (mm$^2$) | Number of white deletion | of white streaks | Gray image |
| Example 1 | 1.1 | 4.0 | 66 | 6677 | 1.4 | 0.3 | 1 | 0 | A |
| Example 2 | 2.0 | 4.0 | 66 | 6677 | 1.9 | 0.35 | 2 | 0 | A |
| Example 3 | 1.5 | 2.0 | 84 | 12300 | 1.1 | 0.2 | 0 | 0 | A |
| Example 4 | 0.8 | 8.0 | 45 | 2350 | 7.8 | 0.15 | 0 | 0 | A |
| Example 5 | 4.6 | 5.0 | 60 | 8040 | 4.3 | 0.45 | 3 | 0 | A |
| Example 6 | 1.1 | 4.0 | 66 | 6677 | 1.4 | 0.25 | 0 | 0 | A |
| Example 7 | 1.1 | 4.0 | 50 | 8169 | 3.2 | 0.2 | 0 | 0 | A |
| Example 8 | 1.5 | 2.0 | 55 | 2055 | 4.4 | 0.33 | 0 | 0 | A |
| Example 9 | 0.8 | 8.0 | 65 | 4036 | 7.3 | 0.10 | 0 | 0 | A |
| Comparative Example 1 | — | — | 66 | 6677 | 2.5 | 1.1 | 11 | 9 | A |
| Comparative Example 2 | 8.4 | 4.0 | 66 | 6677 | 2.5 | 1.0 | 15 | 7 | A |
| Comparative Example 3 | — | — | 84 | 12300 | 1.8 | 1.3 | 17 | 14 | A |
| Comparative Example 4 | — | — | 45 | 2350 | 14.6 | 0.95 | 8 | 9 | C |
| Comparative Example 5 | 13.6 | 5.0 | 60 | 8040 | 9.6 | 1.25 | 14 | 12 | B |
| Comparative Example 6 | — | — | 66 | 6677 | 2.5 | 1.0 | 9 | 8 | A |
| Comparative Example 7 | — | — | 50 | 8169 | 15.6 | 0.55 | 3 | 2 | C |
| Comparative Example 8 | — | — | 55 | 2055 | 17.3 | 0.6 | 5 | 6 | C |
| Comparative Example 9 | — | — | 65 | 4036 | 12.8 | 0.85 | 7 | 10 | C |

3 parts of the electron-donating dye precursor dispersion liquid (BA), 1 part of the sensitizer dispersion liquid (B), 30 parts of the color-forming agent dispersion liquid (BA), 0.8 parts of HYDRIN Z-7 (manufactured by Chukyo Yushi Co., Ltd.) with a concentration of 31%, 0.8 parts of HYDRIN D337 (manufactured by Chukyo Yushi Co., Ltd.) with a concentration of 31%, 1.0 parts of a 2% aqueous solution of sodium (2-ethylhexyl)sulfosuccinate and 9 parts of water were mixed to give a coating liquid for thermosensitive color-forming layer (B1).

[Preparation of Thermosensitive Recording Material]

A void-containing PET support (CRISPER-K2312, manufactured by Toyobo Co., Ltd.) having a thickness of 50 μm was used as a support. The coating liquid for thermosensitive color-forming layer (B1) was coated using a wire bar on the surface of the support so that the post-drying mass of the thermosensitive color-forming layer would become 6.0 g/m$^2$, followed by drying in an oven at 50° C. and calendar treatment to give a thermosensitive recording material (B1). The support had a type D durometer hardness of 66 as defined in accordance with ISO 7619:2004, and a smoothness of 6677 sec as defined in accordance with ISO 5627:1995.

Reference Example 2

[Preparation of Coating Liquid for Protective Layer]

50 parts of polyvinyl alcohol (EP-130, manufactured by Denki Kagaku Kogyo Kabushiki Kaisha) with a concentration of 5%, 0.8 parts of HYDRIN Z-7 (manufactured by Chukyo Yushi Co., Ltd.) with a concentration of 31%, 0.8 parts of HYDRIN D337 (manufactured by Chukyo Yushi Co., Ltd.) with a concentration of 31%, 2.5 parts of zirconium sulfate with a concentration of 1% and 30 parts of water were mixed to give a coating liquid for protective layer (B).

[Preparation of Thermosensitive Recording Material]

A void-containing polypropylene support having a thickness of 80 μm (YUPO FGS, manufactured by YUPO CORPORATION) was used as a support. The coating liquid for thermosensitive color-forming layer (B1) was applied on the surface of the support using a wire bar so that the post-drying mass of the thermosensitive color-forming layer would become 8.0 g/m$^2$, followed by drying in an oven at 50° C. to form a thermosensitive color-forming layer, and then, the coating liquid for protective layer (B) was applied thereon so that the post-drying mass of the protective layer would become 2.0 g/m$^2$, followed by drying in an oven at 50° C. and calendar treatment to obtain a thermosensitive recording material (B2). The support had a type D durometer hardness of 50 as defined in accordance with ISO 7619:2004, and a smoothness of 8169 sec as defined in accordance with ISO 5627:1995.

Reference Example 3

[Preparation of Color-Forming Agent Dispersion Liquid]

20 parts of 4-[4-(1-methylethoxy)phenylsulfonyl]phenol (trade name: D-8, manufactured by Nippon Soda Co., Ltd.) and 70 parts of a 5% aqueous solution of polyvinyl alcohol (PVA-105) were mixed. The mixture was milled using a sand mill to prepare a color-forming agent dispersion liquid (BB) having an average particle diameter of 0.6 μm.

[Preparation of Coating Liquid for Thermosensitive Color-Forming Layer]

A coating liquid for thermosensitive color-forming layer (B3) was obtained in the same manner as in Reference Example 1, except that the color-forming agent dispersion liquid (BB) was used in place of the color-forming agent dispersion liquid (BA) in the preparation of the coating liquid for thermosensitive color-forming layer (B1) in Reference Example 1.

[Preparation of Thermosensitive Recording Material]

A void-containing polypropylene support having a thickness of 70 μm (TOYOPEARL SS, manufactured by Toyobo Co., Ltd.) was used as a support. The coating liquid for thermosensitive color-forming layer (B3) and the coating liquid of Reference Example 2 for protective layer (B) were sequentially applied using a wire bar so that the post-drying mass of the thermosensitive color-forming layer would become 7.0 g/m$^2$ and the post-drying mass of the protective layer would become 2.0 g/m$^2$, followed by drying in an oven at 50° C. and calendar treatment to give a thermosensitive recording material (B3). The support had a type D durometer hardness of 55 as defined in accordance with ISO 7619:2004, and a smoothness of 2055 sec as defined in accordance with ISO 5627:1995.

Reference Example 4

[Preparation of Undercoating Liquid]

100 parts of hollow particles (Hollow Plastic Pigment HPP-055, manufactured by CMKOR Co., Ltd.) with a concentration of 40%, 50 parts of polyvinyl alcohol (trade name: PVA-117, manufactured by Kuraray Co., Ltd.,) with a concentration of 5%, and 2.0 parts of a 2% aqueous solution of sodium (2-ethylhexyl)sulfosuccinate were mixed to prepare an undercoating liquid (B4).

[Preparation of Undercoating Layer]

A void-containing polypropylene support (CARLE TNR70, manufactured by Chisso Corporation) having a thickness of 70 μm was used as a support. The undercoating liquid (B4) was applied on the surface of the support using a wire bar so that the post-drying mass would become 4.0 g/m$^2$, followed by drying in an oven at 50° C. to give an undercoating layer coated support (B4). The support had a type D durometer hardness of 65 as defined in accordance with ISO 7619:2004, and a smoothness of 4036 sec as defined in accordance with ISO 5627:1995.

[Preparation of Thermosensitive Recording Material]

The coating liquid for thermosensitive color-forming layer (B1) of Reference Example 1 and the coating liquid for protective layer of Reference Example 2 (B) were sequentially applied on the undercoating layer coated support (B4) using a wire bar so that the post-drying mass of the thermosensitive color-forming layer would become 6.0 g/m$^2$ and the post-drying mass of the protective layer would become 2.0 g/m$^2$, followed by drying in an oven at 50° C. and calendar treatment to give a thermosensitive recording material (B4).

Reference Example 5

[Preparation of Undercoating Layer]

An undercoating layer coated support (B5) was obtained in the same manner as in Reference Example 4, except that the hollow particle was changed to SX866(B) (manufactured by JSR), and the post-drying mass of the undercoating layer was 6.0 g/m$^2$.

<Preparation of Electron-Donating Dye Precursor-Enclosed Microcapsule Liquid>

14 g of 2-anilino-3-methyl-6-N-ethyl-N-sec-butylaminofluoran as an electron-donating dye precursor, 0.6 g of TINUVIN P (manufactured by Ciba Geigy Corporation) as an ultraviolet absorber, and 10 g of TAKENATE D-110N (manufactured by Takeda Pharmaceutical Company, Ltd.) and 10 g of SUMIJUL N3200 (manufactured by Sumitomo Chemical Co., Ltd.) as a capsule wall agent were dissolved in 20 g of ethyl acetate. The resulting solution was mixed with 112 g of a 5% aqueous solution of polyvinyl alcohol (trade name: PVA217C, manufactured by Kuraray Co., Ltd.). The mixture was emulsified using an ACE HOMOGENIZER (manufactured by Nippon Seiki Co., Ltd.) at 8000 rpm for 5 minutes, and then 142 g of water was further added thereto, followed by reaction at 55° C. for 3 hours to prepare an electron-donating dye precursor-enclosed microcapsule liquid (B) having a capsule size of 0.7 μm.

<Preparation of Color-Forming Agent Emulsion Dispersion>

7 g of color-forming agent (a), 7 g of color-forming agent (b), 16 g of color-forming agent (c) and 11 g of color-forming agent (d), each being represented by the above-stated structural formulae, 1.7 g of tricresyl phosphate, and 0.8 g of diethyl maleate were dissolved in 38 g of ethyl acetate. The resulting color-forming agent solution was mixed with an aqueous solution of 100 g of an 8% aqueous solution of polyvinyl alcohol (PVA205C, manufactured by Kuraray Co., Ltd.), 150 g of water and 0.5 g of sodium dodecylbenzenesulfonate, and the mixture was emulsified using an ACE HOMOGENIZER (manufactured by Nippon Seiki Co., Ltd.) at 10,000 rpm and room temperature for 5 minutes to obtain a color-forming agent emulsified dispersion (B) having an average particle diameter of 1.0 μm.

<Preparation of Thermosensitive Recording Material>

<Formation of Thermosensitive Color-Forming Layer>

5.0 parts of the electron-donating dye precursor-enclosed microcapsule liquid (B) and 40.0 parts of the color-forming agent emulsified dispersion (B) were mixed under stirring to prepare a coating liquid for thermosensitive color-forming layer. The coating liquid was applied on the undercoating layer coated support (B5) so that the amount of solids (post-drying mass) would become 10 g/m$^2$, followed by drying to form a thermosensitive color-forming layer.

<Formation of Protective Layer>

—Preparation of Pigment Dispersion—

15 parts of aluminum hydroxide treated with zinc stearate (trade name: HIGILITE H42S, manufactured by Showa Denko K. K.) were added to 60 parts of water, 5 parts of 10% polyvinyl alcohol (trade name: PVA205, manufactured by Kuraray Co., Ltd.) and 2 parts of 2% sodium dodecylbenzene sulfonate, and dispersed so that the average particle diameter thereof would become 0.7 μm to give a pigment dispersion.

A coating liquid for a protective layer was prepared so as to have the following composition based on the solid content, and applied on the thermosensitive color-forming layer so that the amount of solids (post-drying mass) would become 2.5 g/m$^2$, followed by drying to form a protective layer.

Polyvinyl alcohol: 7 parts
(trade name: PVA124, manufactured by Kuraray Co., Ltd.)

The pigment dispersion obtained above: 12 parts

Paraffin wax emulsion: 0.9 parts
(trade name: CEROZOLE 428, manufactured by Chukyo Yushi Co., Ltd.)

Zinc stearate emulsion: 0.2 parts
(trade name: HIGHMICRON F115, manufactured by Chukyo Yushi Co., Ltd.)

Polyoxyethylene alkyl ether phosphate: 0.05 parts
(trade name: NEOSCORE CM57, manufactured by Toho Chemical Industry Co., Ltd.)

Comparative Reference Example 1

A thermosensitive recording material was obtained in the same manner as in Reference Example 1, except that the support was changed to a void-containing polypropylene support having a thickness of 70 μm (CARLE TNR70, manufactured by Chisso Corporation). The support had a type D durometer hardness of 65 as defined in accordance with ISO 7619:2004, and a smoothness of 4036 sec as defined in accordance with ISO 5627:1995.

Comparative Reference Example 2

A thermosensitive recording material was obtained in the same manner as in Reference Example 2, except that the support was changed to a void-containing polypropylene support having a thickness of 80 μm (Peach Coat SPB-80, manufactured by Nisshinbo Holding, Inc.). The support had a type D durometer hardness of 48 as defined in accordance with ISO 7619:2004, and a smoothness of 2670 sec as defined in accordance with ISO 5627:1995.

Comparative Reference Example 3

A thermosensitive recording material was obtained in the same manner as in Reference Example 4, except that the undercoating layer was not formed.

Comparative Reference Example 4

A thermosensitive recording material was obtained in the same manner as in Reference Example 5, except that the undercoating layer was not formed.

[Evaluation]

(Measurement of Rp Value)

The Rp value at 25° C. of the undercoating layer coated support to be used and the Rp value when heated at 100° C. for 5 sec were measured using a microtopograph (manufactured by Toyo Seiki Seisaku-sho, Ltd.).

When measuring the Rp value, a 5.5 cmϕ pressure contactor was pressed under 5 kg/cm$^2$ for a contact time of 990 ms against the surface of the undercoating layer opposite to the surface thereof in contact with the support in the undercoating layer coated support, using a surface tester "microtopograph" (Toyo Seiki Seisaku-sho, Ltd.), thereby obtaining the Rp value (average value of n=5). On the other hand, when the undercoating layer was not provided, the Rp value was measured by pressing the pressure contactor against the surface of the support at the side where the thermosensitive color-forming layer is to be disposed. Heating was carried out using a hot plate as a heater. The temperature of the heater was set to 100° C. and the undercoating layer coated support (or a support when the undercoating layer was not provided) was heated for 5 sec.

(Evaluation of Actual Images)

Gray images (OD=0.5) were printed on the obtained thermosensitive recording materials using a thermal imager FTI500 (manufactured by FUJIFILM Corporation), and the images (gray images) were visually observed. The obtained results are shown in Table 2. The evaluation criteria are as follow.

A: uniform and smooth image

B: slight unevenness in image density

C: significant unevenness in image density with white deletion portions

TABLE 2

| | Support hardness | Rp value (25° C.) | Rp value (100° C.) | Gray image quality |
|---|---|---|---|---|
| Reference Example 1 | 66 | 1.8 | 2.6 | A |
| Reference Example 2 | 50 | 2.5 | 4.3 | A |
| Reference Example 3 | 55 | 3.8 | 7.8 | A |
| Reference Example 4 | 65 | 1.2 | 5.1 | A |
| Reference Example 5 | 65 | 1.6 | 4.8 | A |
| Comparative Reference Example 1 | 65 | 2.7 | 12.8 | C |
| Comparative Reference Example 2 | 48 | 3.2 | 15.6 | C |
| Comparative Reference Example 3 | 65 | 2.7 | 12.8 | C |
| Comparative Reference Example 4 | 6.5 | 2.7 | 12.8 | C |

All publications, patent applications, and technical standards mentioned in this specification are herein incorporated by reference to the same extent as if each individual publication, patent application, or technical standard was specifically and individually indicated to be incorporated by reference.

What is claimed is:

1. A thermosensitive recording material comprising, on a support having a type D durometer hardness of 40 or more as defined in accordance with ISO 7619:2004, and sequentially from the support side, an undercoating layer having a dynamic microhardness at 25° C. of 5.0 mN or less; and a thermosensitive color-forming layer containing an electron-donating dye precursor and an electron-accepting compound for thermal color-formation of the electron-donating dye precursor.

2. The thermosensitive recording material according to claim 1, wherein the smoothness on the surface of the support at the side having the undercoating layer, as defined in accordance with ISO 5627:1995, is 2,000 sec or more.

3. The thermosensitive recording material according to claim 1, wherein the undercoating layer contains polymer particles and a binder.

4. The thermosensitive recording material according to claim 1, wherein the undercoating layer contains hollow particles having a particle diameter of 0.5 μm or greater.

5. The thermosensitive recording material according to claim 1, wherein the undercoating layer contains a pigment and polymer particles.

6. The thermosensitive recording material according to claim 1, wherein the coating amount of the undercoating layer is from 1 to 10 $g/m^2$.

7. The thermosensitive recording material according to claim 1, wherein the support is a transparent support, a synthetic paper, or a resin-coated paper.

8. The thermosensitive recording material according to claim 1, wherein the Rp value of the support, as measured by a microtopograph when heated at 100° C. for 5 sec, is 10 or less.

9. The thermosensitive recording material according to claim 1, wherein the Rp value of the undercoating layer on the support, as measured by a microtopograph when heated at 100° C. for 5 sec, is 10 or less.

* * * * *